US007614767B2

(12) United States Patent
Zulim et al.

(10) Patent No.: US 7,614,767 B2
(45) Date of Patent: Nov. 10, 2009

(54) NETWORKED ARCHITECTURAL LIGHTING WITH CUSTOMIZABLE COLOR ACCENTS

(75) Inventors: Don Zulim, Conyers, GA (US); Stephen Haight Lydecker, Snellville, GA (US); Leslie Charles King, Loganville, GA (US); Jon Dale Hinnefeld, Conyers, GA (US)

(73) Assignee: ABL IP Holding LLC, Conyers, GA (US)

( * ) Notice: Subject to any disclaimer, the term of this patent is extended or adjusted under 35 U.S.C. 154(b) by 404 days.

(21) Appl. No.: 11/449,768

(22) Filed: Jun. 9, 2006

(65) Prior Publication Data

US 2007/0285921 A1 Dec. 13, 2007

(51) Int. Cl.
*F21V 7/00* (2006.01)

(52) U.S. Cl. ..... 362/296.01; 362/249.02; 362/297; 362/304; 362/346; 362/85; 362/243

(58) Field of Classification Search ..... 362/296.01, 362/297, 304, 305, 341, 346, 85, 209, 230, 362/235–248, 322

See application file for complete search history.

(56) References Cited

U.S. PATENT DOCUMENTS

| | | | | |
|---|---|---|---|---|
| 2,686,866 A | | 8/1954 | Williams | |
| 4,001,637 A | * | 1/1977 | Gray | 315/205 |
| 4,096,555 A | * | 6/1978 | Lasker | 362/302 |
| 4,164,008 A | * | 8/1979 | Miller et al. | 362/103 |
| 4,885,747 A | * | 12/1989 | Foglia | 370/490 |
| 5,329,431 A | * | 7/1994 | Taylor et al. | 362/85 |
| 6,016,038 A | | 1/2000 | Mueller et al. | |
| 6,150,774 A | | 11/2000 | Mueller et al. | |
| 6,211,626 B1 | | 4/2001 | Lys et al. | |
| 6,340,868 B1 | | 1/2002 | Lys et al. | |
| 6,489,728 B2 | * | 12/2002 | Guthrie et al. | 315/200 A |

(Continued)

FOREIGN PATENT DOCUMENTS

GB 2409024 A 6/2005

(Continued)

OTHER PUBLICATIONS

Marketing literature from Color Kinetics Incorporated, "Color Kinetics: Products & Services: Lighting Systems" [online]; Retrieved Dec. 9, 2005 from the Internet: <URL:http://colorkinetics.com/products/pro/>(7 pages).

*Primary Examiner*—Sandra L O'Shea
*Assistant Examiner*—Danielle Allen
(74) *Attorney, Agent, or Firm*—Sutherland Asbill & Brennan LLP

(57) ABSTRACT

The present invention provides systems and apparatuses for dynamically controlling the operational modes of a single luminaire or a group of networked luminaires configured to deliver an illumination pattern having a decorative colored glow surrounding a central region of substantially uniform brightness. A control module for the luminaire is configured to drive three dimmable fluorescent ballasts, as well as a LED module. A variety of operational modes including different schemes for color mixing and color cycle control can be selected by a user and implemented by a microcontroller. A group of luminaires is connected in a standard communication protocol-based master-slave configuration, where the slave units respond to commands received from the master unit, and the last slave unit automatically engages terminating and biasing resistors for proper operation of the network.

22 Claims, 27 Drawing Sheets

U.S. PATENT DOCUMENTS

| | | | | |
|---|---|---|---|---|
| 6,513,962 | B1 * | 2/2003 | Mayshack et al. | 362/583 |
| 6,590,323 | B1 | 7/2003 | Stekelenburg | |
| 6,608,453 | B2 | 8/2003 | Morgan et al. | |
| 6,747,420 | B2 | 6/2004 | Barth et al. | |
| 6,777,891 | B2 | 8/2004 | Lys et al. | |
| 6,788,011 | B2 | 9/2004 | Mueller et al. | |
| 6,806,659 | B1 | 10/2004 | Mueller et al. | |
| 6,888,529 | B2 | 5/2005 | Bruning et al. | |
| 6,896,394 | B2 | 5/2005 | Houle | |
| 6,908,214 | B2 | 6/2005 | Luk | |
| 7,014,341 | B2 | 3/2006 | King et al. | |
| 7,145,125 | B2 | 12/2006 | May et al. | |
| 2001/0050852 | A1 | 12/2001 | Jones | |
| 2004/0036424 | A1 | 2/2004 | Hsieh | |
| 2004/0052076 | A1 | 3/2004 | Mueller et al. | |
| 2004/0066148 | A1 | 4/2004 | Oskorep et al. | |
| 2004/0085030 | A1 | 5/2004 | Laflamme et al. | |
| 2004/0207341 | A1 | 10/2004 | Callahan | |
| 2005/0007025 | A1 | 1/2005 | Gauna | |
| 2005/0073848 | A1 * | 4/2005 | King et al. | 362/296 |
| 2005/0077839 | A1 | 4/2005 | Ho | |
| 2005/0110426 | A1 | 5/2005 | Shao | |
| 2005/0116667 | A1 | 6/2005 | Mueller et al. | |
| 2005/0122065 | A1 | 6/2005 | Young | |
| 2005/0128751 | A1 | 6/2005 | Roberge et al. | |
| 2005/0168168 | A1 | 8/2005 | Elliott | |
| 2005/0174473 | A1 | 8/2005 | Morgan et al. | |
| 2005/0254241 | A1 | 11/2005 | Harwood | |

FOREIGN PATENT DOCUMENTS

| | | |
|---|---|---|
| WO | WO 03/026358 | 3/2003 |

* cited by examiner

1100

| 1101 COLOR SWITCH POSITION | 1102 FUNCTION | 1103 TIMER SET TO "00" FOR FIXED COLOR | 1104 TIMER NOT SET TO "00" |
|---|---|---|---|
| 1115 | | | |
| 1105 0 | RED GREEN BLUE | WARM WHITE | |
| 1106 1 | COLORS GROW FROM WHITE | WHITE | |
| 1107 2 | COLORS GROW FROM BLACK | COOL WHITE | |
| 1108 3 | RED YELLOW GREEN | | |
| 1109 4 | RED MAGENTA BLUE | | |
| 1110 5 | GREEN CYAN BLUE | | |
| 1111 6 | RED | | |
| 1112 7 | GREEN | | |
| 1113 8 | BLUE | | |
| 1114 9 | SELF DIAGNOSTICS | SELF TEST | SELF TEST |

FIG. 11

1300

1302

| 1308 CYCLE TIME | 1310 SWITCH A | 1312 SWITCH B |
|---|---|---|
| 1314 FIXED COLOR | 0 | 0 |
| 1316 5 SEC | 0 | 1 |
| 1318 10 SEC | 0 | 2 |
| 1320 15 SEC | 0 | 3 |
| 1322 30 SEC | 0 | 5 |
| 1324 35 SEC | 0 | 6 |
| 1326 45 SEC | 0 | 8 |

1304

| 1308 CYCLE TIME | 1310 SWITCH A | 1312 SWITCH B |
|---|---|---|
| 1 MIN. | 1 | 0 |
| 5 MIN. | 1 | 8 |
| 10 MIN. | 2 | 4 |
| 15 MIN. | 2 | 5 |
| 30 MIN. | 2 | 8 |
| 45 MIN. | 3 | 1 |
| 60 MIN. | 3 | 4 |

1306

| 1308 CYCLE TIME | 1310 SWITCH A | 1312 SWITCH B |
|---|---|---|
| 2 HOURS | 4 | 6 |
| 4 HOURS | 5 | 4 |
| 8 HOURS | 6 | 6 |
| 12 HOURS | 7 | 4 |
| 16 HOURS | 8 | 2 |
| 20 HOURS | 9 | 0 |
| 24 HOURS | 9 | 8 |

FIG. 13

NETWORKED ARCHITECTURAL LIGHTING WITH CUSTOMIZABLE COLOR ACCENTS

FIELD OF THE INVENTION

The present invention relates to architectural lighting. More particularly, it relates to networked lighting units with customizable color accents.

BACKGROUND OF THE INVENTION

Architectural lighting has served a pivotal role in modern interior design, where light fixtures not only provide adequate general illumination to a space, but they also enhance the aesthetic appeal of certain areas or objects within that space. Adding colored light in a certain spatial pattern relative to a typically uniformly distributed white light creates a contrasting effect that easily catches the viewers' attention. Thus, a luminaire with a color accent is very attractive for certain environments, such as a showroom that displays commercial merchandise, a museum that displays art objects, a hotel or corporate office lobby that provides enhanced illumination to a personnel desk, a performance stage that provides focused illumination on a certain area or a certain performer et cetera.

One conventional way to provide color accent lighting is to bundle multiple luminaires in a close proximity, each emitting light of a single color, to create a color mixture. With this approach, however, the size of the combined fixtures becomes substantial. In addition, controlling the intensity of each luminaire, and synchronizing it with other luminaire outputs, is complicated and cumbersome.

Luminaires using color filters, such as colored glass or polymeric sheets, to produce a desired color effect are also available. Filtered color, however, is often greatly attenuated, and it fails to deliver adequate clarity or glow to create a dramatic effect. Additionally, it is difficult to dynamically change the output accent color using filters because most filters are designed for use within a certain range of wavelengths.

Light emitting diodes (LEDs) that emit colored light are available. LEDs are typically smaller in size than other light sources, but conventional control circuits to drive colored LEDs are complex and unsuitable for integration in luminaires. Available user-interface modules for controlling colored LEDs also provide minimal color programming functionality.

Conventional lighting control systems also have limitations as illustrated by the system of FIG. 1. For example, conventional luminaires electrically connected together so that their light output is controllable from a single user-interface module cannot be individually controlled and managed. As a result, it is not possible, for example, using a conventional lighting control system to change the intensity or color output of one luminaire of a string of luminaires without effecting the intensity or color output of the other luminaires.

As shown in FIG. 1, a conventional lighting system 100 includes several luminaires 102*a*-102*n* that are electrically connected in series with wiring 112. The luminaires are controlled by a controller 103 that includes a user interface module 106 and a circuit interface box 104. User interface module 106 is typically wall-mounted for easy access. Circuit interface box 104 is connected to user interface module 106 with electrical wiring 108 and to luminaire 102*a* with electrical wiring 110. User interface module 106 and circuit interface box 104 both have their own power supply. User interface module 106 typically includes one or more dimmer switches 105, in which each dimmer switch controls the intensity of all of the lamps of luminaires 102*a*-102*n* having a particular color (e.g., red lamps).

In the example shown in FIG. 1, luminaires 102*a*-102*n* include red lamps, green lamps, and blue lamps, and user interface module 106 includes three dimmer switches 105, one for adjusting red lamps, one for adjusting green lamps, and one for adjusting blue lamps. One of the dimmer switches 105, for example, adjusts the intensity of all of the red lamps in luminaires 102*a*-102*n*. Mixed color output is created by adjusting the relative intensity of individual colors. In conventional lighting system 100, all luminaires 102*a*-102*n* output the same color.

What is needed is architectural lighting and a control system that overcomes the deficiencies noted above.

BRIEF SUMMARY OF THE INVENTION

The present invention provides architectural lighting units with customizable color accents and a control system therefor. The architectural lighting units can be used individually or networked together to form a lighting system. When operating alone or as part of a lighting system, each architectural lighting unit can be dynamically controlled and configured to deliver an illumination pattern having a decorative colored glow surrounding a central region of substantially uniform brightness.

In one embodiment, the fixture of each architectural lighting unit includes a plurality of reflectors, namely, an inner reflector, an outer reflector, and a medial reflector. An inner surface of the inner reflector is used to reflect and direct light emitted by a fluorescent lamp. A portion of an inner surface of the outer reflector is used to reflect colored light emitted by a plurality of colored light sources mounted on a circuit board disposed within an inner space of the outer reflector. The reflected colored light enters a colored light mixing portion of the outer reflector and exits the colored light mixing portion through a plenum formed by an outer surface of the inner reflector and an inner surface of the medial reflector.

In one embodiment of the present invention, each architectural lighting unit has a control module capable of operating three dimmable fluorescent ballasts and a color LED module. A variety of operational modes are provided having different schemes for color mixing and color cycle control. The control module includes a universal input power supply based on flyback converter technology.

It is a feature of the present invention that individual architectural lighting units can be networked together, for example, using an RS485 communication protocol-based master-slave configuration. In an embodiment, slave units respond to commands received from a master unit. The last slave unit in a string of units automatically engages terminating and/or biasing resistors for proper operation of the network. Dual-line phone cables can be used for coupling an LED module to its driver circuit, and Ethernet cables can be used for inter-luminaire networking.

Additional features and advantages of the present invention, as well as the structure and operation of various embodiments of the present invention, are described in detail below with reference to the accompanying drawings.

BRIEF DESCRIPTION OF THE DRAWINGS/FIGURES

The accompanying drawings, which are incorporated herein and form part of the specification, illustrate the present invention and, together with the description, further serve to explain the principles of the invention and to enable persons skilled in the pertinent arts to make and use the invention.

FIG. 11 is a diagram illustrating example operational modes for a luminaire according to an embodiment of the present invention.

FIG. 13 is a diagram illustrating an example matrix for controlling luminaire color cycle times according to an embodiment of the present invention.

The present invention will be described with reference to the accompanying drawings. The drawing in which an element first appears is typically indicated by the leftmost digit (s) in the corresponding reference number.

DETAILED DESCRIPTION OF THE INVENTION

The present invention provides architectural lighting units with customizable color accents and a control system therefore. In the detailed description of the invention herein, references to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Figure 1:
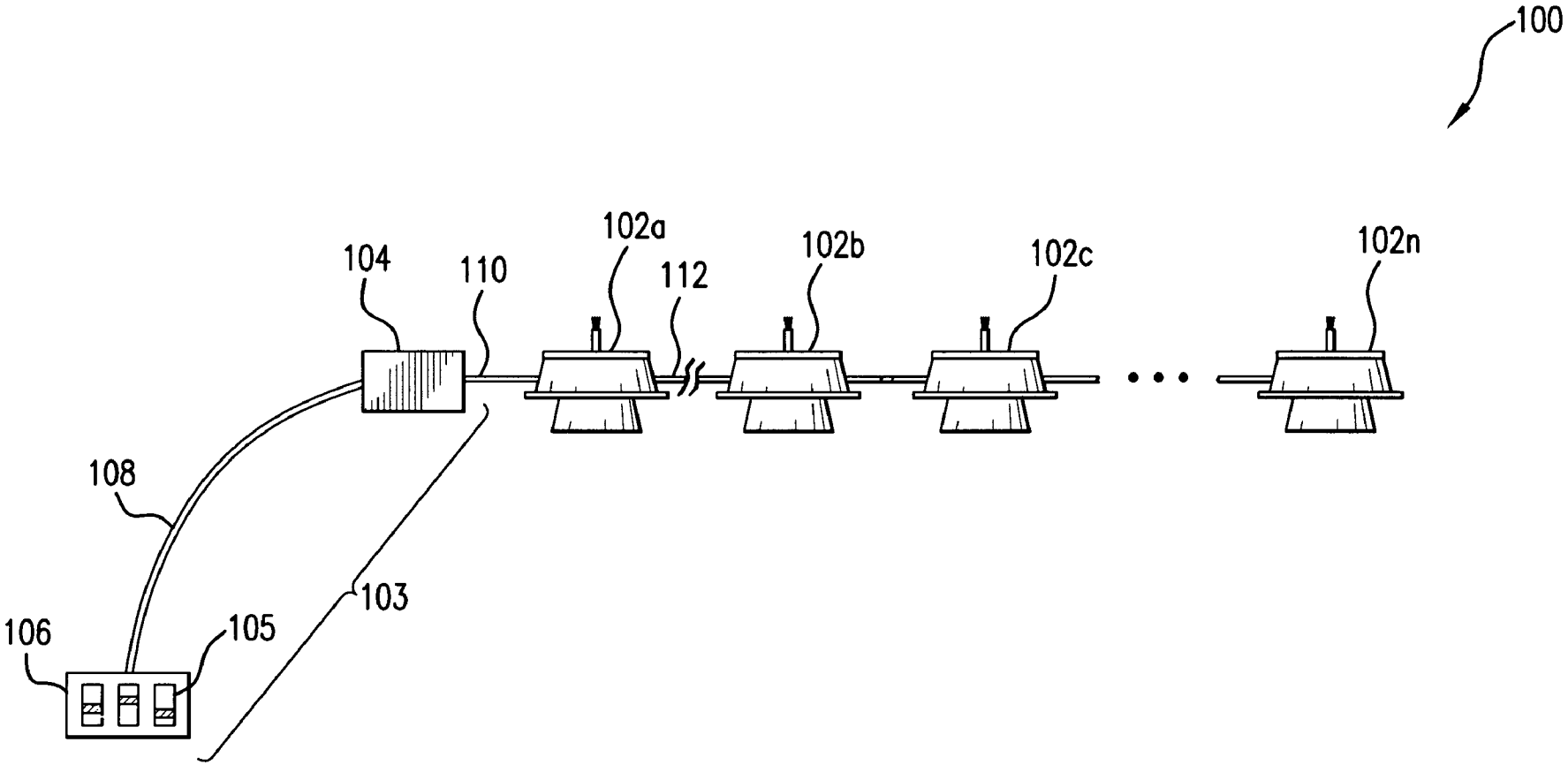
FIG. 1 is a diagram illustrating a conventional light system.
Figure 2:
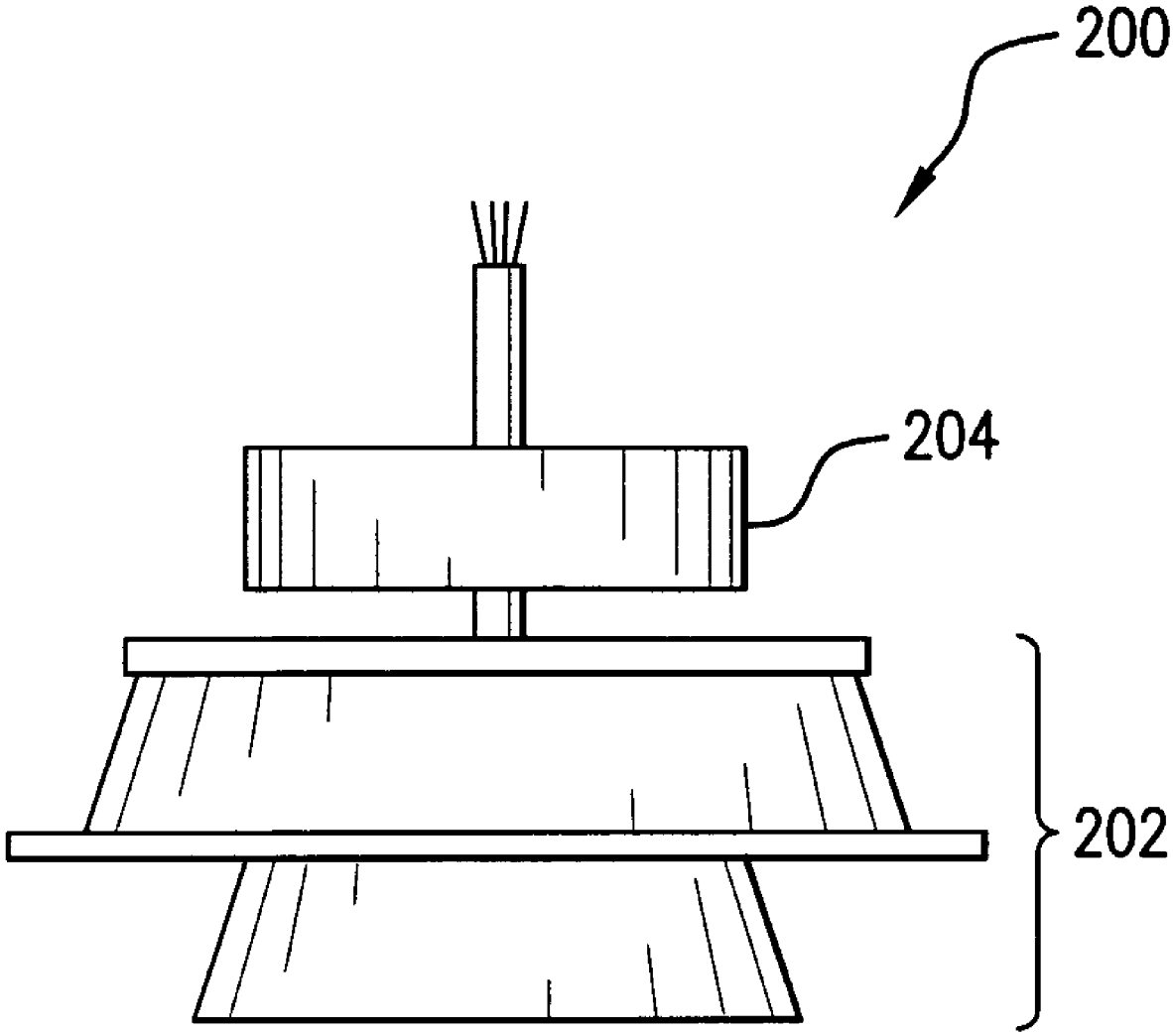
FIG. 2 is a diagram illustrating a first luminaire according to an embodiment of the present invention.

FIG. 2 illustrates an example luminaire 200 according to an embodiment of the present invention. Luminaire 200 includes a fixture 202 and a control module 204. Luminaire 200 is preferably a decorative luminaire suitable for interior or exterior lighting, and it may be recess mounted, surface mounted, wall mounted, or suspended.

Luminaire 200 can be used alone or networked together with other luminaires to form a lighting system. When operating alone or as part of a lighting system, each luminaire 200 can be dynamically controlled and configured to deliver an illumination pattern having a decorative colored glow surrounding a central region of substantially uniform brightness.

In one embodiment, fixture 202 includes a plurality of reflectors. An inner reflector is used to reflect and direct light emitted by one or more fluorescent lamps. An outer reflector is used to reflect colored light emitted by a plurality of colored light sources mounted on a circuit board disposed within the outer reflector.

In one embodiment, control module 204 is capable of operating one or more dimmable fluorescent ballasts and a color LED module. A variety of operational modes are provided for driving the LED module. The different modes provide different schemes for color mixing and color cycle control. Control module 204 preferably includes a universal input power supply based on flyback converter technology.

Figure 3:
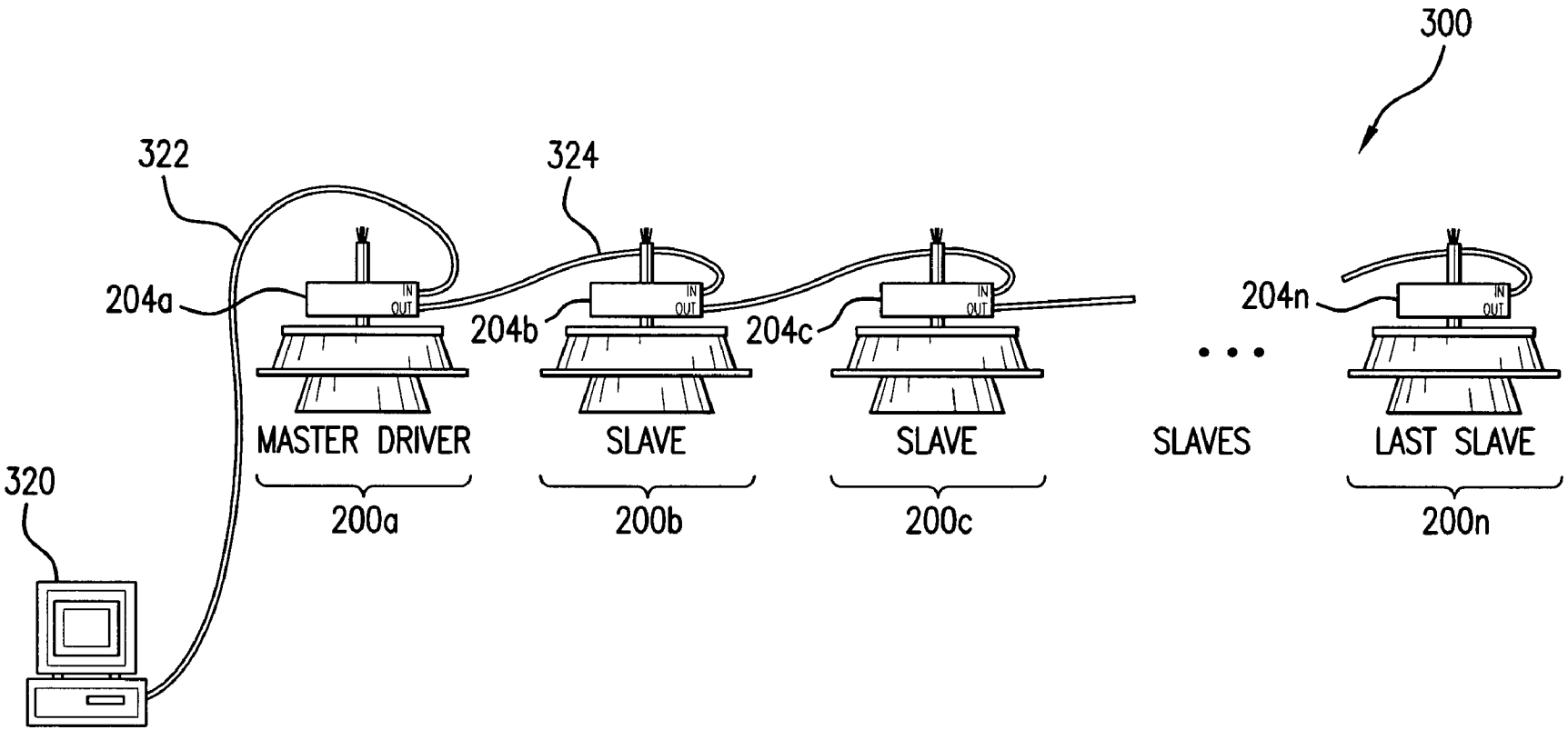
FIG. 3 is a diagram illustrating a light system according to an embodiment of the present invention.

FIG. 3 illustrates a lighting system 300 according to an embodiment of the present invention. Lighting system 300 includes a plurality of luminaires 200*a*-200*n*. Luminaires 200*a*-200*n* are networked and can be individually controlled via inter-luminaire network links 324 through a central controller 320 (e.g., a computer). Controller 320 sends control signals via network link 322 to the first luminaire 200*a*, which relays control signals to other luminaires via network links 324. Controller 320 may be embodied in hardware, software, or any combination thereof.

In the example shown in FIG. 3, controller 320 is a computer, which may have one or more graphical user interfaces appearing on its screen for controlling the operational modes of luminaires 200*a*-200*n*. For example, the computer may have virtual instrumentation software, such as LabVIEW™ installed in it, which creates mouse-clickable buttons on the computer screen, simulating switches for controlling the operational modes of the luminaires. Luminaires 200*a*-200*n* have corresponding integrated network input and output ports through which they are connected to neighboring luminaires.

As shown in FIG. 3, luminaires 200*a*-200*n* may be daisy-chained in a master-slave configuration, where luminaire 200*a* is acting as the master, and the rest of the luminaires are slaves controlled by luminaire 200*a*. Any number of luminaires may be daisy-chained. In an embodiment, up to 99 luminaires can be connected in a daisy chain on the same network. Network links 322 and 324 may be standard Ethernet cables (e.g., CAT5 Ethernet cables). The network input and output ports may include standard RJ45 connectors. There may be two separate connectors for network IN and network OUT connections. The network ports may be coupled to communication hardware based on the RS485 communications protocol, which is designed for long-distance networking. A microcontroller may control a network transmitter chip mounted on a controller circuit board, as discussed in more detail below with reference to FIG. 14.

Figure 4:
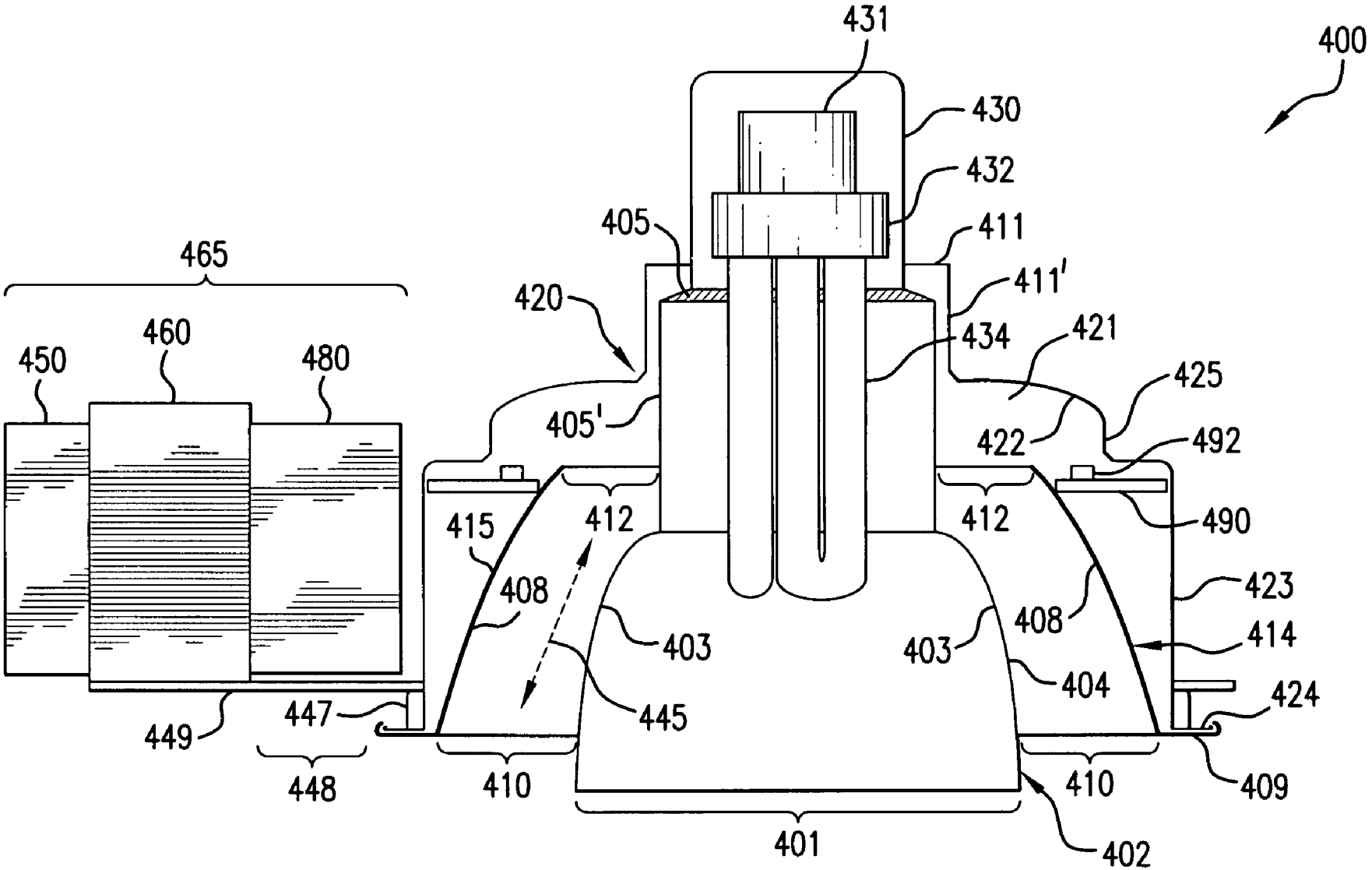
FIG. 4 is a diagram illustrating a second luminaire according to an embodiment of the present invention.

FIG. 4 illustrates a luminaire 400 according to an embodiment of the present invention. Luminaire 400 is an architectural lighting unit intended to be a recessed mounted.

Luminaire 400 can be used to blend or 'disappear' into an interior architecture, such as a dropped ceiling or a wall. A complete lighting unit consists of, for example, one or multiple lamps together with other mechanical and electrical components required to position the lamps, distribute the light, and connect the lamps to a power supply. For recessed downlighting, luminaire 400 is mounted within a recess above a dropped ceiling so that only a metal trim, part of a reflector and a lamp, may be visible from outside, while the metal brackets, lamp socket, power supply, illumination control module etc. are hidden. It should be noted that in the following description, terms indicative of an orientation, such as "top", "bottom", up etc. are merely used for descriptive convenience, and the invention and the components thereof are not limited to any particular spatial orientation.

As shown in FIG. 4, luminaire 400 comprises a socket cup 430, a lamp 434, an inner reflector 402, a medial reflector 414, an outer reflector 420, a control module 465, a mounting frame 448 that couples outer reflector 420 with control module 465, and a circuit board 490 disposed within an inner space of outer reflector 420, where circuit board 490 houses a plurality of colored light sources 492. In this example embodiment, each of the reflectors has a hollow inner space.

Socket cup 430 has a socket 431 that is configured to hold one or more lamp 434. Lamp 434 has a base 432 that couples lamp 434 within socket 431. Lamp 434 may be a type of gas discharge lamp, such as a compact fluorescent lamp (CFL), or a standard fluorescent tube. It can also be an incandescent lamp, or a LED-based light source. Typically, lamp 434 emits white light, or monochromatic colored light. Lamp 434 may be designed to deliver decorative light effect as well. Lamp 434 is electrically connected to control module 465. Control module 465 may include a ballast 450 for driving lamp 434. Lamp 434 is typically used as the primary source of illumination generated by luminaire 400, whose intensity may be adjusted. In FIG. 4, lamp 434 is shown to be mounted vertically in an upright position. Lamp 434 may be mounted vertically, horizontally, or at an angle in between the vertical and horizontal positions.

Inner reflector 402 includes an inner surface 403, an outer surface 404, and a first end portion, comprising top portion 405, and a cylindrical sidewall 405'. Reflector 402 couples to socket cup 430 and has an opening or aperture 401 at a second end portion opposite to top portion 405. Reflector 402 may be dual-finished, with inner surface 403 having a specular finish, and outer surface 404 having either a specular finish or a matte-finish. Inner surface 403 is used to reflect light emitted by lamp 434. Lamp 434 is at least partially disposed within the inner space of inner reflector 402. Reflected light and direct light emitted by lamp 434 exits luminaire 400 through an aperture 401.

Outer reflector 420 includes a first end portion, comprising a top portion 411 and a cylindrical sidewall 411', a second end portion with a rim portion 424 opposite to top portion 411, a sidewall 423 connected to rim portion 424, and a colored light mixing portion 425 coupled to sidewall 423 and cylindrical sidewall 411'. Reflector 402 and reflector 420 are concentric, and inner reflector 402 is at least partially disposed within the inner space of outer reflector 420, leaving an annular space surrounding aperture 401 of inner reflector 402. The first end portion of inner reflector 402 is coupled to the first end portion of outer reflector 420. Reflector 420 serves as an exterior housing for luminaire 400.

Colored light mixing portion 425 has a light mixing chamber 421 and a reflective inner surface 422, which is configured to reflect mixed colored light. As described in more detail below, colored light emitted by a plurality of colored light sources enters light mixing chamber 421. Reflective inner surface 422 may have an optical coating which may alter the spectrum of the colored light that enters light mixing chamber 421 and gets reflected by inner surface 422.

Medial reflector 414 is shaped substantially like a truncated hollow cone, and is disposed within the inner space of outer reflector 420. Reflector 414 has an outer surface 415, a reflective inner surface 408, and a rim portion 409 coupled to rim portion 424 of reflector 420. An aperture at the base of reflector 414 is equal or smaller in dimension than the aperture at the base of reflector 420, but larger in dimension than aperture 401, creating an annular aperture 410. Additionally, an aperture at the top of reflector 414 is larger in dimension than an outer dimension of cylindrical sidewall 405' of reflector 402, creating another annular aperture 412. Reflective inner surface 408 of reflector 414 and a portion of outer surface 403 of reflector 402 form a reflective plenum 445 with annular aperture 412 at the top and annular aperture 410 at the bottom.

A plurality of colored light sources 492 are mounted on a circuit board 490. Circuit board 490 is disposed within the inner space of reflector 420 with appropriate supporting means. Circuit board 490 may be annular-shaped.

Figure 5:
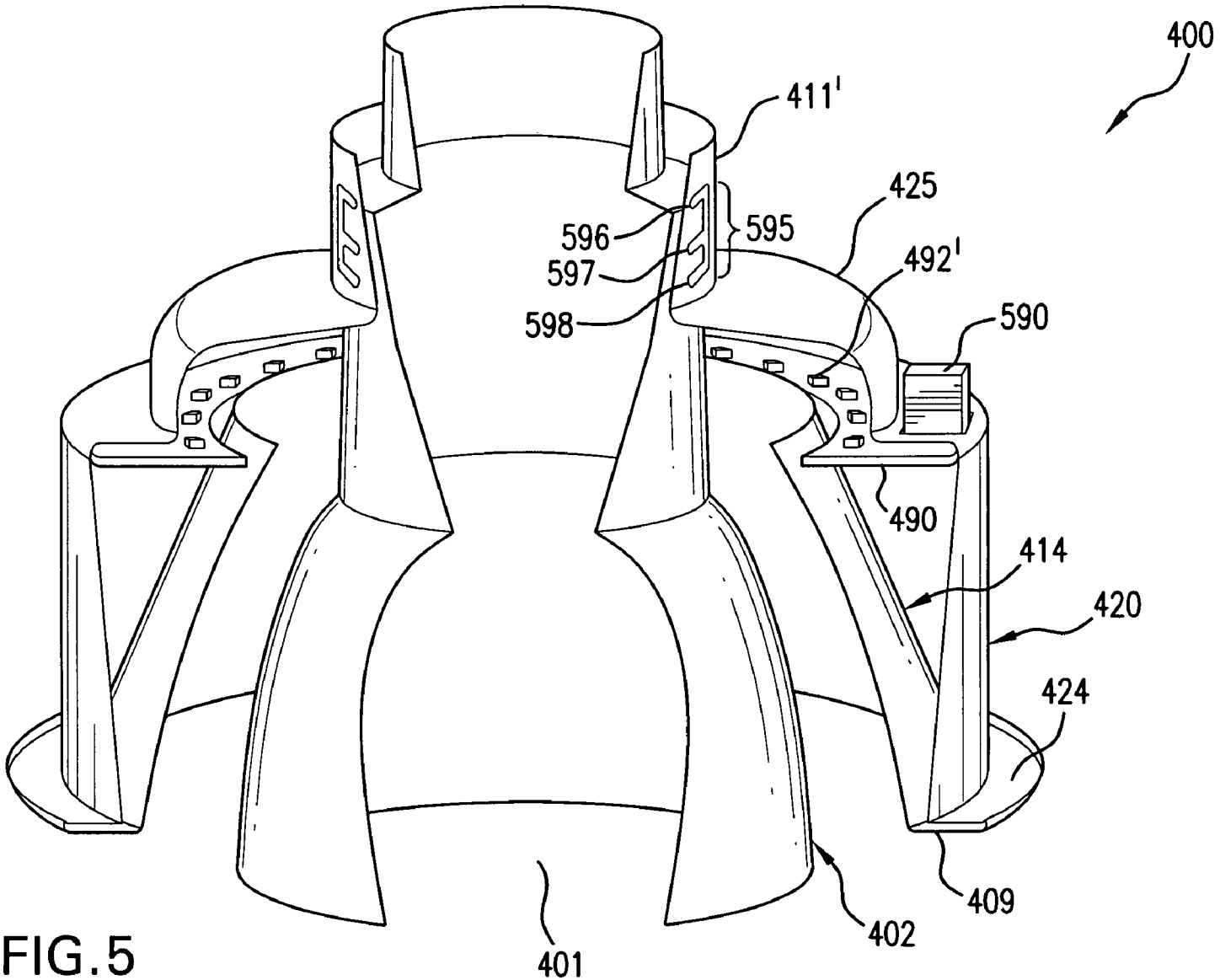
FIG. 5 is a diagram illustrating a cut-away view of the luminaire of FIG. 4.

In one embodiment, colored light sources 492 may be colored LEDs, as shown in greater detail in FIG. 5 (component 492'). LEDs may be discrete colored LEDs, or multicolor Red-Green-Blue (RGB) LED chips. Other multicolored LED chips may be used. Colored LED chips are configured to provide any color inside a CIE chromaticity chart including saturated colors. The LED chips may be assembled in standard packages, e.g., surface mountable 6-pin packages, which are mounted on circuit board 490. Other packages can be used too.

In another embodiment, colored light sources 492 comprise a plurality of color-coated lamps providing three different colors.

Light emitted by the colored light sources points upwards and enters the light mixing chamber 421 of colored light mixing portion 425 of reflector 420. Colored light then gets mixed and reflected by inner reflective surface 422. The spectrum of the reflected colored light may be different than the spectrum of the light emitted by the colored light sources, if reflective surface 422 has certain optical coatings, or has a certain shape. Reflected light then passes through plenum 445, and exits through annular aperture 410 at the base of the plenum. Plenum 445 is preferably a reflective plenum (e.g., a plenum formed using reflective surfaces).

Mounting frame 448 includes a mounting ring 447, and an extended arm portion 449 coupled to mounting ring 447. Mounting ring 447 is coupled to outer reflector 420, and provides mechanical support to luminaire 400. Arm portion 449 mechanically couples control module 465 with the rest of the luminaire. Control module 465 includes a colored light control module 480, a lamp ballast module 450, and a power supply module 460. Modules 460, 450, and 480 are coupled to each other.

Lamp ballast module 450 may include a dimmable ballast. A ballast is a device that is used to start a gas discharge lamp such as a CFL, and to regulate current flow once the discharge has been started. An intensity of lamp 434 may be controlled by the dimmable ballast to create a desired illumination effect. Instead of a dimmable ballast, a standard multi-volt, multi-watt ballast may be used.

If color-coated CFLs are used as colored light sources, a plurality of dimmable fluorescent ballasts are also included in a luminaire. A luminaire accommodating multiple color-coated CFLs may require a modified reflector and housing design. The plurality of dimmable ballasts may be coupled to the plurality of color-coated CFLs via three independent control signal channels. The first control signal channel controls the CFLs emitting the first colored light (e.g. red light), the second control signal channel controls the CFLs emitting the second colored light (e.g. green light), and the third control signal channel controls the CFLs emitting the third colored light (e.g. blue light).

Power supply module 460 may be a universal input power supply module that utilizes a flyback converter topology to provide dual output voltages. The higher of the dual output voltages drives the plurality of colored light sources, and the lower of the output voltages drives other electronic and communication components. For example, power supply module 460 may have a 120/220/230/277 Volts AC, 50/60 Hz input, and is designed to provide 9 Watts of output power. Power supply module 460 may provide 24 Volts DC power for driving LEDs (colored light source 492'). Power supply module 460 may also be configured to provide 0-10 Volts DC analog signals to the three dimmable fluorescent ballasts controlling the color-coated fluorescent CFLs. Power supply module 460 also supplies power to the lamp ballast that controls lamp 434.

Colored light control module 480 houses required circuitry for controlling the operational modes of luminaire 400. Additional details regarding colored light control module 480 are provided further below.

FIG. 5 shows a cut-away view of the reflectors and the colored light ring of luminaire 400. As shown in FIG. 5, the position of inner reflector 402 may be adjusted in a vertical direction concentrically with respect to outer reflector 420, such that the aperture 401 of reflector 402 is either flush with rim 424 of reflector 420 (as well as rim 409 of medial reflector 414, which is coupled to rim 424), or in a different plane above or below the plane of the rim of reflector 420. For example, a three-position notch 595 on cylindrical sidewall 411' of outer reflector 420 allows inner reflector 402 to be adjusted to any of three example positions—flush with rim 424 corresponding to notch 596; 0.375 inches lower than rim 424, corresponding to notch 597, and 0.75 inches lower than rim 424, corresponding to notch 598. This way, the output intensity of luminaire 400, and the visual effect that it produces can be varied.

FIG. 5 also shows an electrical connector 590 mounted on circuit board 490. A portion of electrical connector 590 may protrude through a cut-out in reflector 420. There may be more than one electrical connector 590. Electrical connector 590 may be a standard RJ11 connector, which is a receptacle that can accommodate a standard telephone jack. Control signals are carried to LEDs 492' via electrical wires, such as standard dual-line telephone cables. Thus, electrical connector 590 acts as the interface between control module 465 and circuit board 490. Using standard electrical cables and connectors provide ease in installment, operation, and maintenance of luminaire 400.

FIGS. 6A-6D shows perspective views of reflectors 402, 420, and 414, and circuit-board 490 on which LEDs 492' are mounted.

Figure 6B:
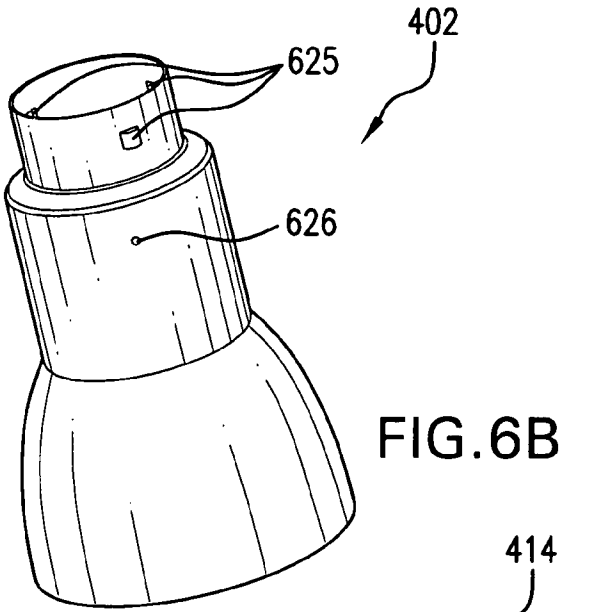
FIGS. 6A-6D are more detailed diagrams illustrating the luminaire of FIG. 4.
Figure 6C:
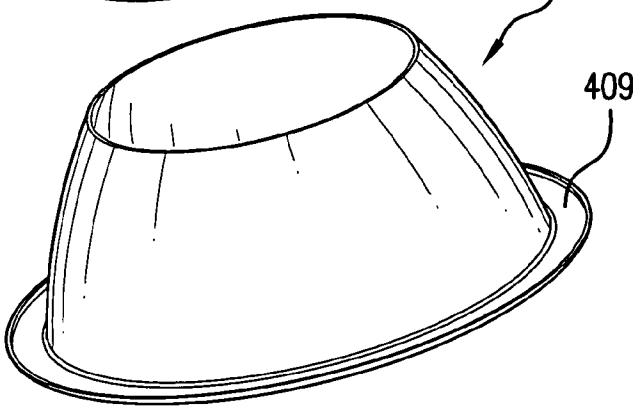
Figure 6A:
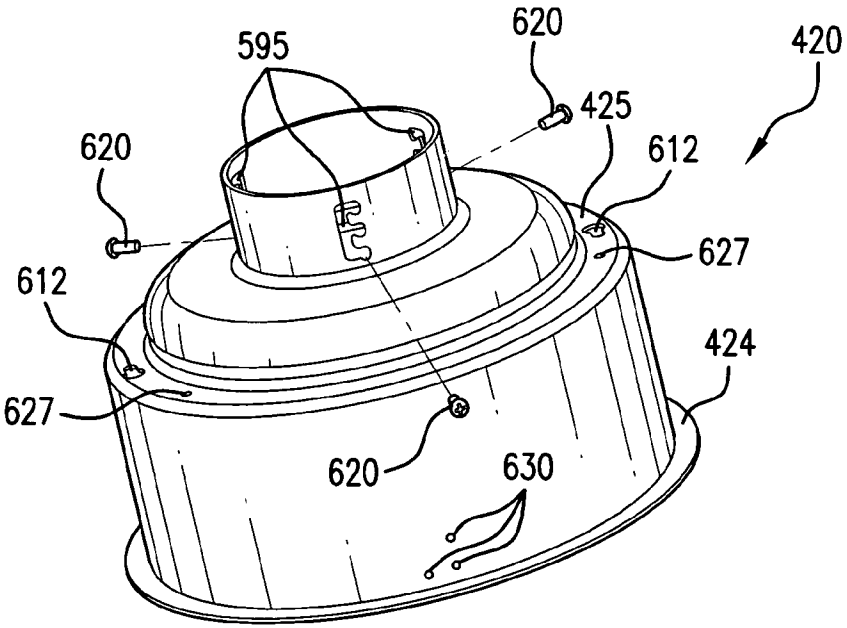

FIG. 6A shows outer reflector 420, which is also the exterior housing for luminaire 400. Notches 595 enable vertical height adjustment of inner reflector 402 (shown in FIG. 6B) relative to outer reflector 420. Notches 625 couple inner reflector 402 with socket 430. Holes 626 on inner reflector 402 correspond to one of the three positions in notches 595, such that inner reflector 402 and outer reflector 420 are mechanically coupled by screws 620 going through the notches. Outer reflector 420 also has notches 630 on its outer surface for mating with mounting frames (see FIGS. 7-9). Outer reflector 420 also has holes 612 and notches 627 for accommodating various fastening means. FIG. 6C shows medial reflector 414, which is inserted in between reflector 402 and reflector 420, as shown in FIG. 5. Rim 409 of reflector 414 is coupled with rim 424 of reflector 420.

Figure 6D:
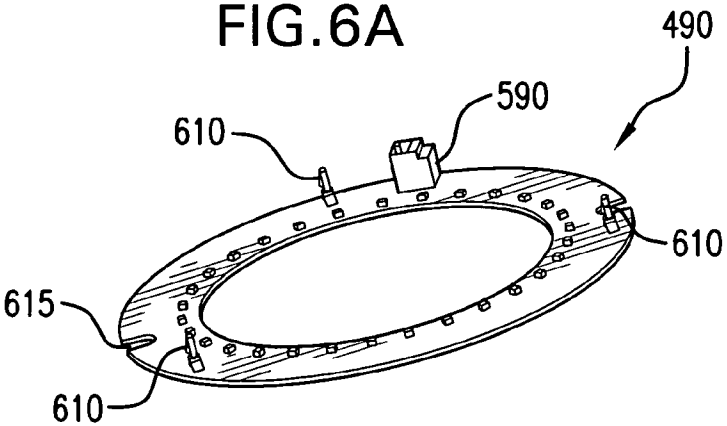

Circuit board 490 is disposed between outer reflector 420 and medial reflector 414, and is mounted at a location near the bottom of the colored light mixing portion 425 of reflector 420. Circuit board 490 may have one or more notches 615 and one or more fastening means 610 (such as screws or snap-on standoffs) to be attached to one of the reflectors of the luminaire. For example, standoffs 610 (shown in FIG. 6D) go through standoff holes 627 (shown in FIG. 6A) at the base of colored light mixing portion 425 to couple circuit board 490 with outer reflector 420. There may be any number of LEDs 492', arranged in any pattern on the circuit board 490. For example, in case of an annular-shaped circuit board 490, LEDs 492' may be arranged in a circular array or a ring pattern, as shown in FIG. 6D. Circuit board 490 may have marks or references on its surface to indicate where each of the LED 492' should be mounted. Electrical connector 590, which may be an RJ11 connector, is mounted on circuit board 490. There may be more than one electrical connector 590.

Figure 7:
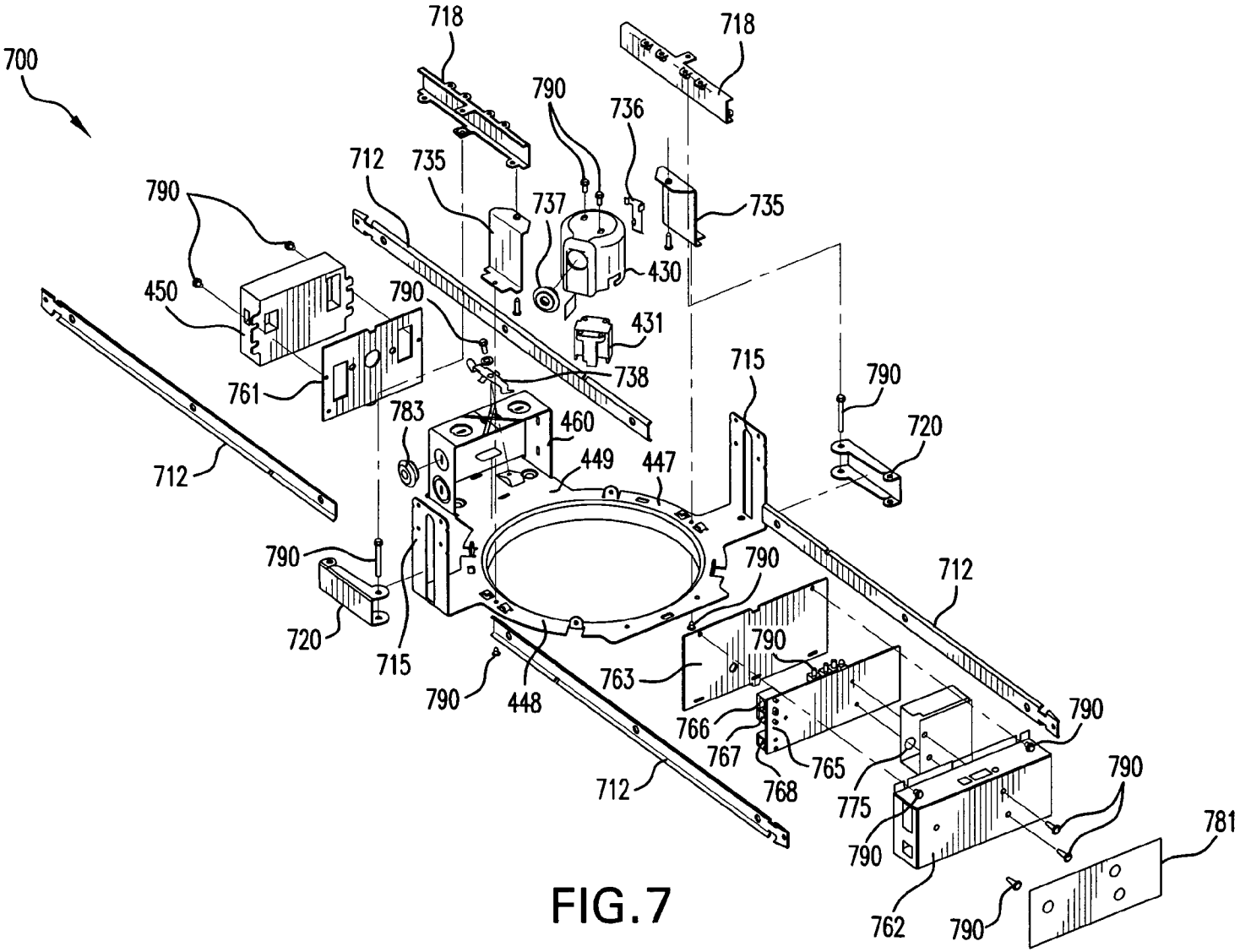
FIG. 7 is a diagram illustrating a mounting assembly for the luminaire of FIG. 4.

FIG. 7 shows a perspective view of a typical mounting assembly 700 for luminaire 400. Mounting assembly 700 fixes luminaire 400, for example, to a ceiling of a building. The example mounting assembly 700 shown in FIG. 7 includes four mounting rail bars 712, two supporting arms 715, two latch brackets 718, two latch arms 720, two Z-brackets 735, and various screws 790.

Some of the luminaire components previously shown in FIG. 4 (such as socket cup 430, socket 431, lamp ballast module 450, power supply module 460, colored light control module 480, and mounting frame 448), are shown in FIG. 7. Additional components of luminaire 400, not shown in FIG. 4, are also shown in FIG. 7. These components include a printed circuit board (PCB) 765 that has the driver circuitry for driving LEDs 492', PCB mount box 762 and its cover 763, network ports 767 and 768, electrical connector 766, insulating material block 775, and instruction label 781, all of which are included in the colored light control module 480; an electrical connector 783, a snap-on door clip 738, and a cover plate 761, all of which are included in power supply module 460; and a socket clip 736, and an electrical connector 737, both of which are included in socket cup 430.

Figure 8:
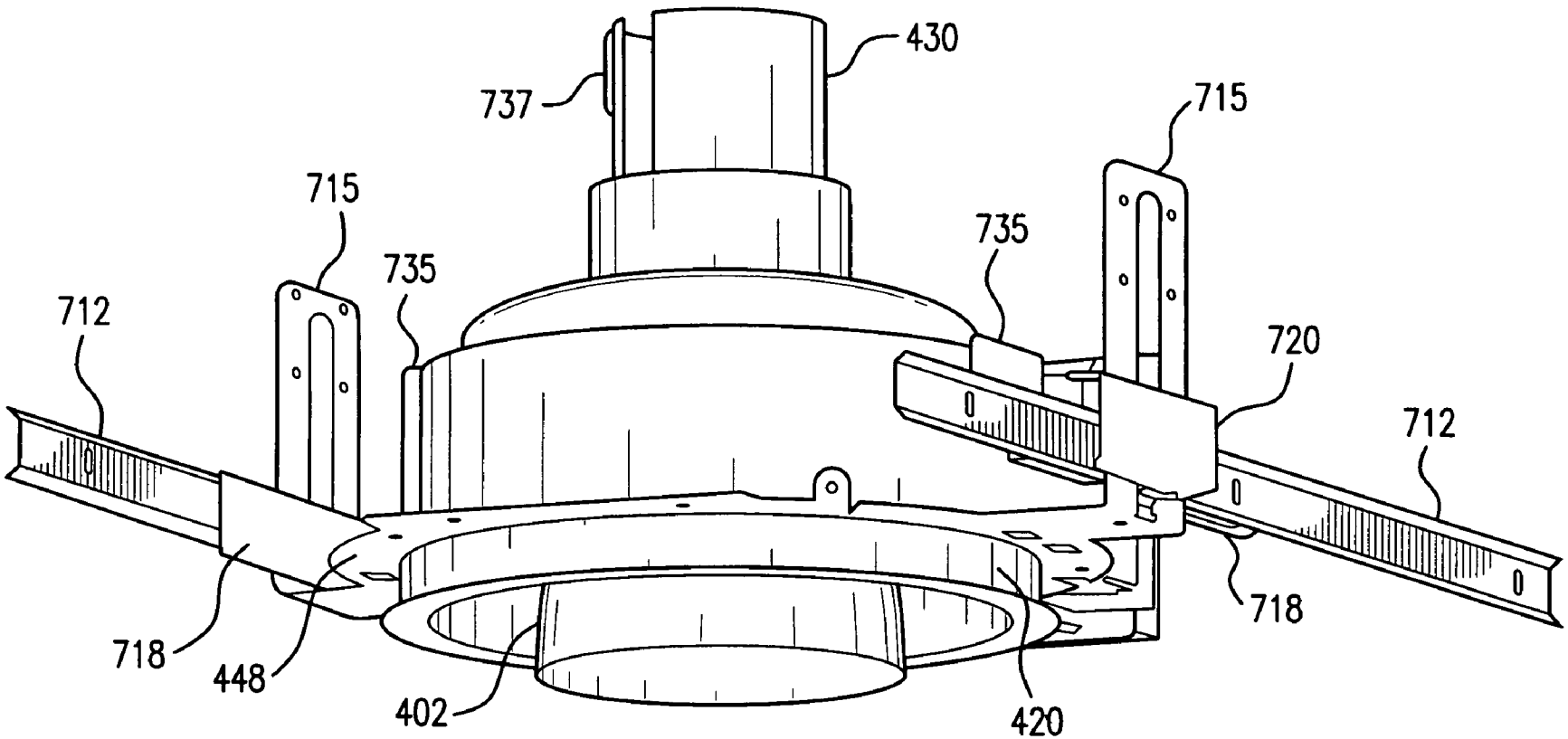
FIG. 8 is a diagram illustrating the luminaire of FIG. 4 and the mounting assembly of FIG. 7.

FIG. 8 shows the perspective view of luminaire 400 and mounting assembly 700 combined, viewed from the bottom and the front. Mounting frame 448 is coupled to reflector 420 by Z-brackets 735. Supporting arms 715 extend upward from the base of mounting frame 448. Mounting rail bars 712 are fastened to supporting arms 715 by latch brackets 718, and latch arms 720. Electrical connector 737 couples socket cup 430 with power supply module 460 via electrical connector 783.

Figure 9:
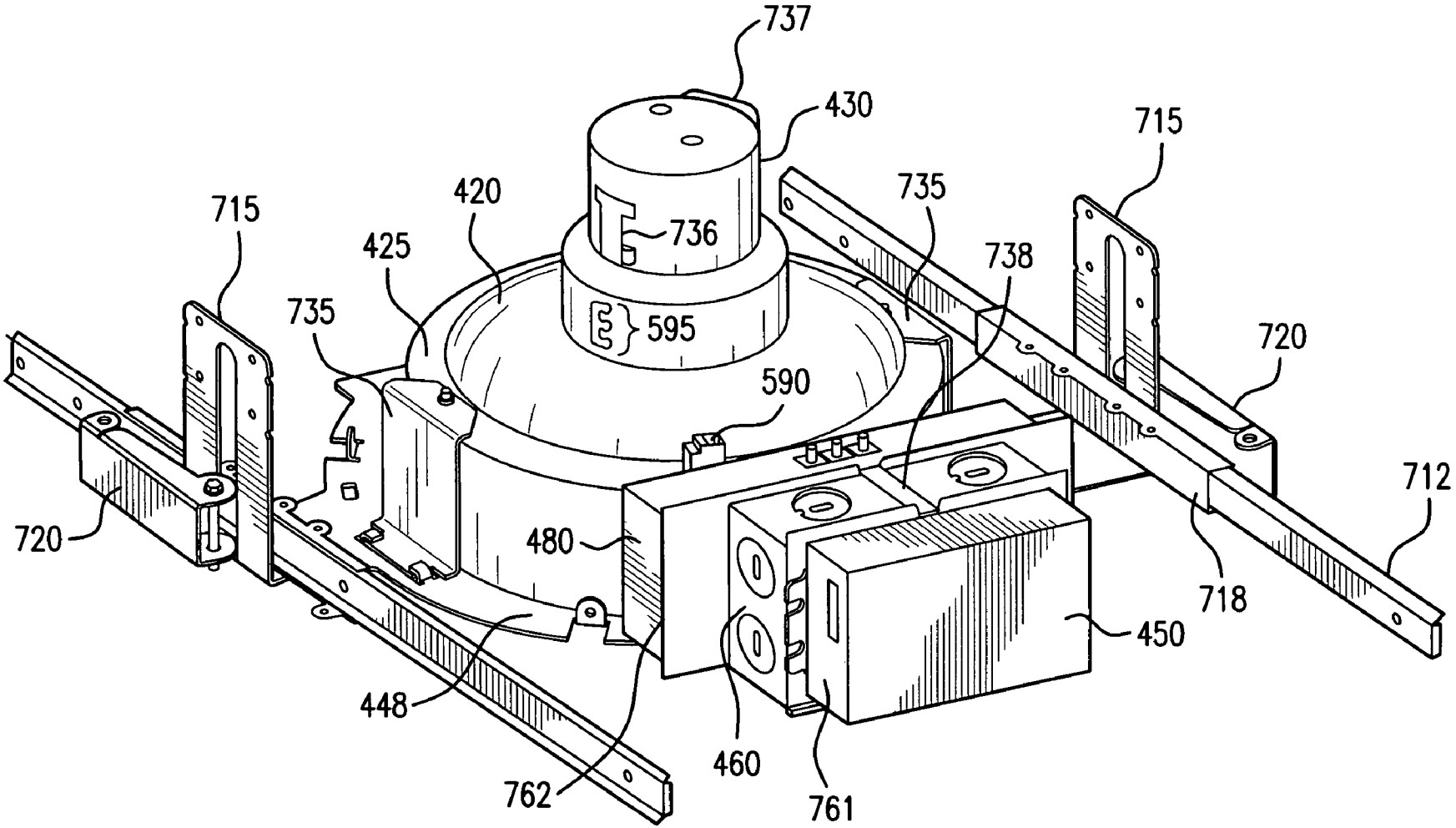
FIG. 9 is a diagram illustrating the luminaire of FIG. 4 and the mounting assembly of FIG. 7.

FIG. 9 shows the perspective view of luminaire 400 and mounting assembly 700 combined, viewed from the top and the back. This view shows socket clip 736 which couples socket cup 430 with reflector 402 (not shown), notch 595 on reflector 420 that helps adjust the relative position of reflector 402, electrical connector 590 that brings in signal from electrical connector 766 on PCB 765 (in FIG. 7) to colored light sources 492, colored light control module 480, PCB mount box 762, power supply module 460, snap-on door clip 738 that mechanically couples power supply module 460 with colored light control module 480, lamp ballast module 450, and cover plate 761 that mechanically couples lamp ballast module 450 with power supply module 460. Insulating material block 775 and PCB 765 are not visible in this view. However, insulating material block 775 electrically insulates PCB 765 from an encasing structure of colored light control module 480. Also not visible is the instruction label 781 which has printed instructions and warnings related to the operation of colored light control module 480.

Figure 10A:
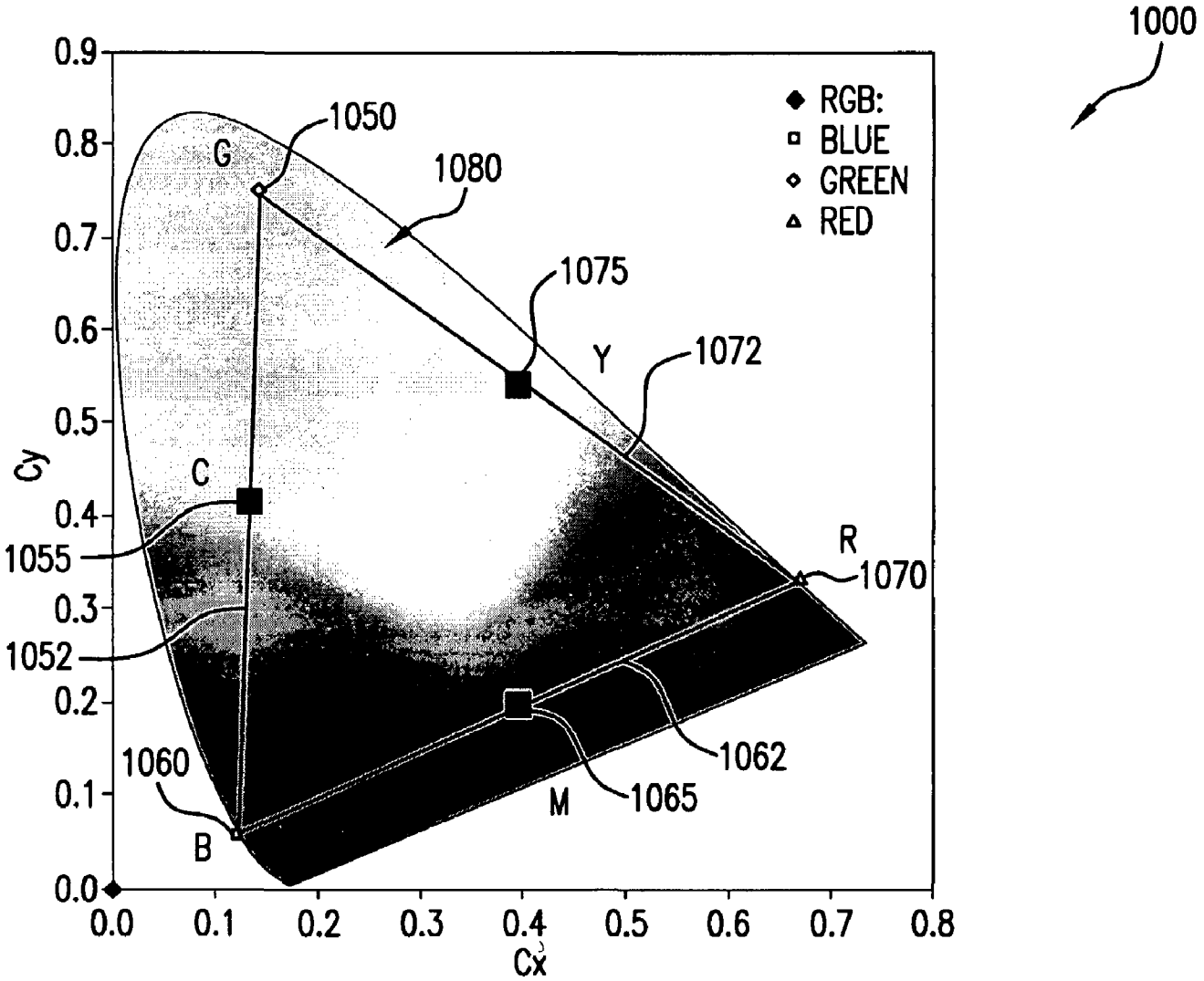
FIG. 10A is a diagram illustrating a typical CIE chromaticity chart.

FIG. 10A shows a CIE chromaticity chart 1000. A CIE chart is used to represent the colors that viewers with a normal color vision can see. Cx and Cy on the x and y axes represent chromaticity coordinates. Colored light sources 492 emit primary colors: red (R), green (G), and blue (B), shown by vertices 1070, 1050, and 1060 of a color gamut triangle 1080. Ideally it is possible to provide any color inside CIE chart 1000 by designing the reflectors properly. Saturated colors represented by the points along edges 1052, 1062, and 1072 are typically used for decorative display. Examples of mixed saturated colors include magenta (M) at point 1065, yellow (Y) at point 1075, and cyan (C) at point 1055.

Figure 10B:
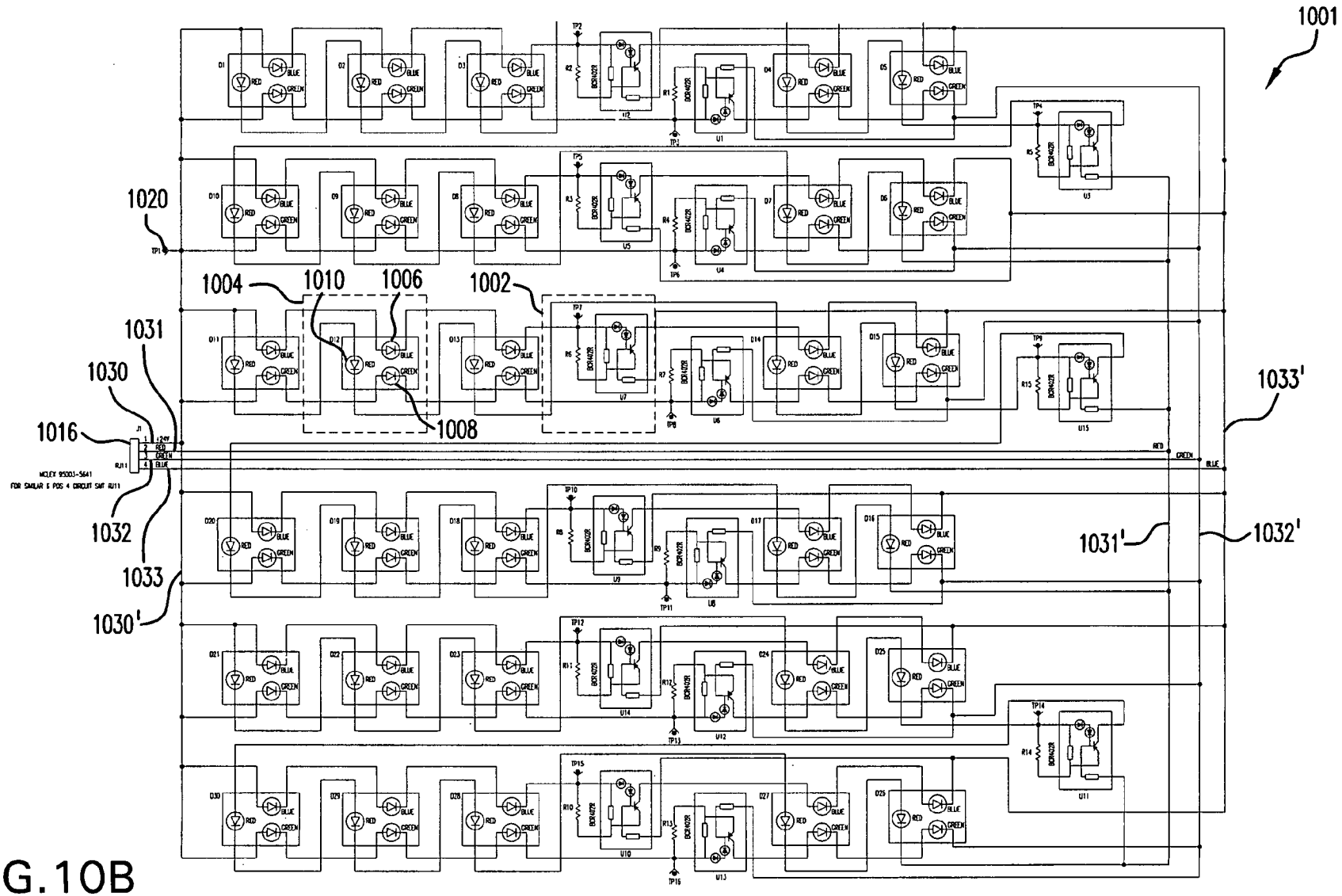
FIG. 10B is a diagram for a portion of a LED light module according to an embodiment of the present invention.

FIG. 10B shows a diagram of a circuit 1001 for an embodiment of luminaire 400 which includes colored LEDs 492'. Circuit 1001 is implemented on circuit board 490. Circuit 1001 comprises RGB LED modules 1004 (similar to LEDs 492') connected to their corresponding drivers 1002, signal bus 1031' for driving red LEDs, signal bus 1032' for driving green LEDs, signal bus 1033' for driving blue LEDs, power bus 1030', electrical connector 1016, and tap points 1020.

Tap points 1020 are the points in circuit 1001 through which operators (such as maintenance personnel) can access the components of the circuit. In the example shown in FIG. 10B, there are 16 tap points (marked TP1-16).

Electrical connector 1016 serves as an interface that brings power and control signals to circuit 1001. Connector 1016 is similar to connector 590, discussed above with reference to FIG. 5. In the example circuit shown in FIG. 10B, connector 1016 is a RJ11 connector (e.g. Molex vertical RJ11 standard profile 95003-6641) with four pins 1030, 1031, 1032, and 1033. Pin 1030 is connected to power bus 1030', supplying for example 24 Volts bias voltage for the circuit. Pin 1031 is connected to signal bus 1031' driving red LEDs, pin 1032 is connected to signal bus 1032' driving green LEDs, and pin 1033 is connected to signal bus 1033' driving blue LEDs.

Each LED driver 1002 can supply bias current to two RGB LED modules 1004. In the example shown in FIG. 10B, 30 LED modules 1004 (marked D1-D30) and 15 LED drivers 1002 (marked U1-U15) are shown. Each LED module 1004 may have a red LED 1006, a green LED 1008, and a blue LED 1010. LEDs 1006, 1008, and 1010 may deliver any other color as well.

An example of multicolor RGB LED module 1004 is the LATB-G66B module from Osram Sylvania, Inc., which comes in 6-pin surface mountable packages that can be mounted on circuit board 490. Other types of LEDs can be used as well.

An example of LED driver 1002 is module BCR402R from Infenion Technologies, Inc., coupled with external resistor R6, as shown within the dashed rectangle in FIG. 10B.

FIG. 11 shows various operational modes of a luminaire according to an embodiment of the present invention, such as luminaire 400. These modes are controlled, for example, by control module 465 through a programmable user interface described with reference to FIG. 3.

In an embodiment, intelligent control of LED operational modes is implemented by multiple Binary Coded Decimal (BCD) switches included in control module 465. Implementation is realized by hardware alone, or a combination of hardware and software. One 0-9 position BCD switch controls a functional mode of the luminaire output, while two additional 0-9 position BCD switches control cycle time for each color.

An example matrix 1100 for the operational modes of a luminaire according to an embodiment of the present invention is presented in FIG. 11. The first column 1101 in matrix 1100 indicates the position of a master color mix switch for mode control. The second column 1102 indicates the functional mode corresponding to the position of the master color mix switch. The third column 1103 indicates the output color when a timer is set to "00" to deliver fixed color. The fourth column 1104 indicates the output color transition when the timer is set to some number other than "00". Rows 1105 to 1114 in matrix 1100 indicate various example operational modes. For example, row 1105 indicates that, when the master color mix switch is set to position 0, red, green and blue lights are emitted and mixed in the color mix chamber of the luminaire, resulting in a constant warm white glow when the timer is set for fixed color, or resulting in cyclically varying red, green, and blue glow, when the timer is set to vary the color cycle. Similarly, other combinations of the color switch position and timer setting result in a varying output pattern for the luminaire. One of the positions of the color switch may be allocated for self-diagnostics operational mode (e.g. position 9 in FIG. 11).

Figure 12C:
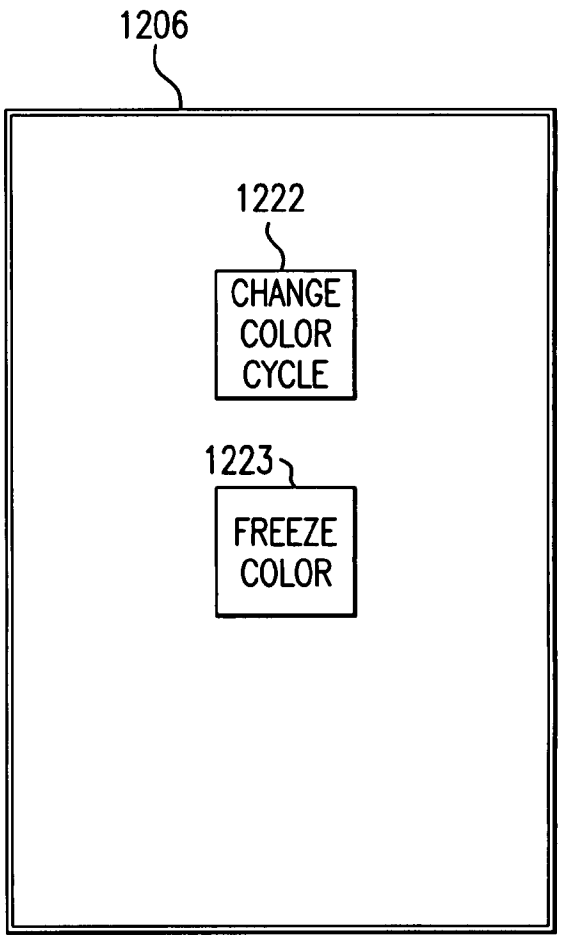
FIGS. 12A-12C are diagrams illustrating example user interfaces for controlling luminaires according to an embodiment of the present invention.
Figure 12B:
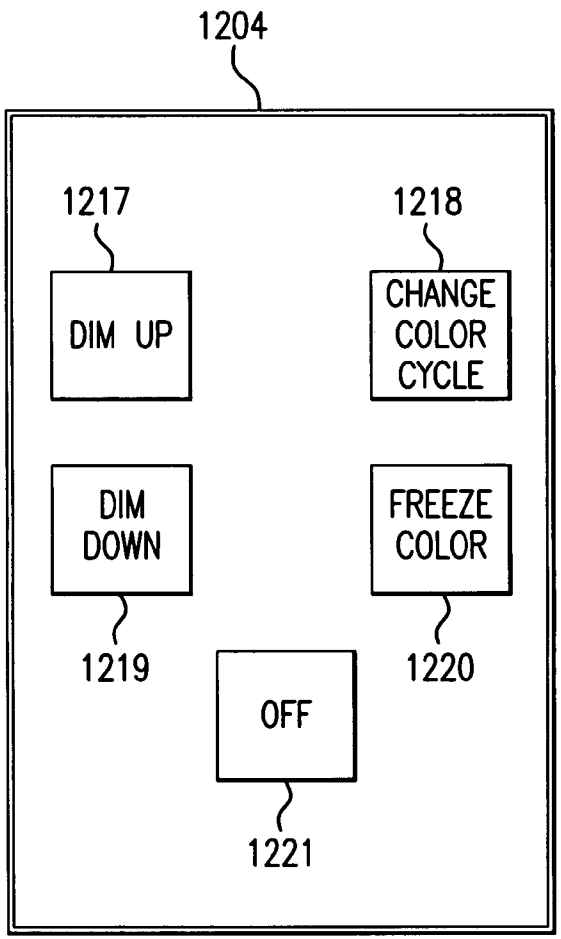
Figure 12A:
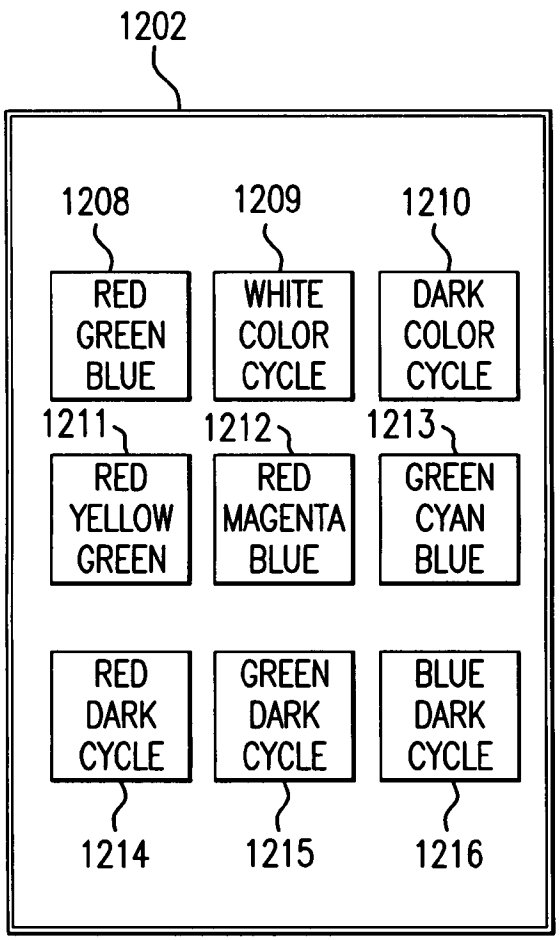

FIGS. 12A-12C show example user interfaces 1202, 1204, and 1206 for a luminaire and/or lighting system according to an embodiment of the present invention. Note that these interfaces may either be physical interface boards or may be embodied virtually in software coupled to corresponding hardware on a computer screen.

User interface 1202 in FIG. 12A features a 9-button station including buttons 1208-1216 on a faceplate. Each of the buttons corresponds to one of the functional modes described in FIG. 11 (column 1102). For example, switch 1210 ("Dark Color Cycle") may correspond to the functional mode where colors grow from black (column 1102, row 1107 in matrix 1100 of FIG. 11). Similarly, switch 1216 ("Blue Dark Cycle") may correspond to the functional mode where only blue color is delivered (column 1102, row 1113 in matrix 1100 of FIG. 11). For self diagnostics mode, there may be additional buttons (not shown), or other mechanism, such as two or more buttons being pressed simultaneously. Color cycle time may be selected by switches not shown on the faceplate. For example, color cycle time switches may be located behind the faceplate. Depending on the setting of color cycle time switches, buttons 1208-1216 are used either for selecting a pre-set color cycle timing (timer not set to '00'), or for 'color freeze' or a fixed color output (timer set to '00').

User interface 1204 in FIG. 12B features a 5-button station including buttons 1217-1221 on a faceplate. In this configuration, a user presses button 1218 ("Change Color Cycle") to step through the nine color modes (column 1102, rows 1105-1113 in FIG. 11). As in FIG. 12A, color cycle time may be selected by switches located behind the faceplate. Button 1220 ("Freeze Color") is pressed to set the timer to '00', delivering color corresponding to column 1103 in FIG. 11. Buttons 1217 ("Dim Up") and 1219 ("Dim Down") allow the user to adjust the level of a dimming ballast (similar to module 450 in FIG. 4). In this configuration, station 1204 may be powered by a transformer relay coupled to the ballast. Button 1221 ("Off") may be pressed to turn colored light off, or the entire luminaire off.

User interface 1206 in FIG. 12C features a simpler 2-button station including buttons 1222-1223 on a faceplate. Similar to FIG. 12B, a user presses button 1222 ("Change Color Cycle") to step through the nine color modes (column 1102, rows 1105-1113 in FIG. 11). Color cycle time may be selected by switches located behind the faceplate. Button 1223 ("Freeze Color") is pressed to set the timer to '00', delivering color corresponding to column 1103 in FIG. 11.

FIG. 13 shows an example matrix 1300 for controlling color cycle times in the timing switches for the dynamic luminaire. Two switches, switch A and switch B are set to specific values, which in combination, represent a two-digit code corresponding to a color cycle time. Section 1302 of matrix 1300 lists the two-digit codes corresponding to 0-45 seconds (in discrete steps), section 1304 lists codes corresponding to 1-60 minutes (in discrete steps), and section 1306 lists codes corresponding to 2-24 hours (in discrete steps). Columns 1308, 1310, and 1312 in all three sections represent cycle time (a first value to which switch A is set and a second value to which switch B is set). Rows 1316-1328 in all three sections represent the different color cycle and corresponding code combinations. For example, if switch A is set to 0 and switch B is set to 8, then the two-digit code '08' (row 1328 in section 1302) represents a color cycle time of 45 seconds.

Figure 14A:
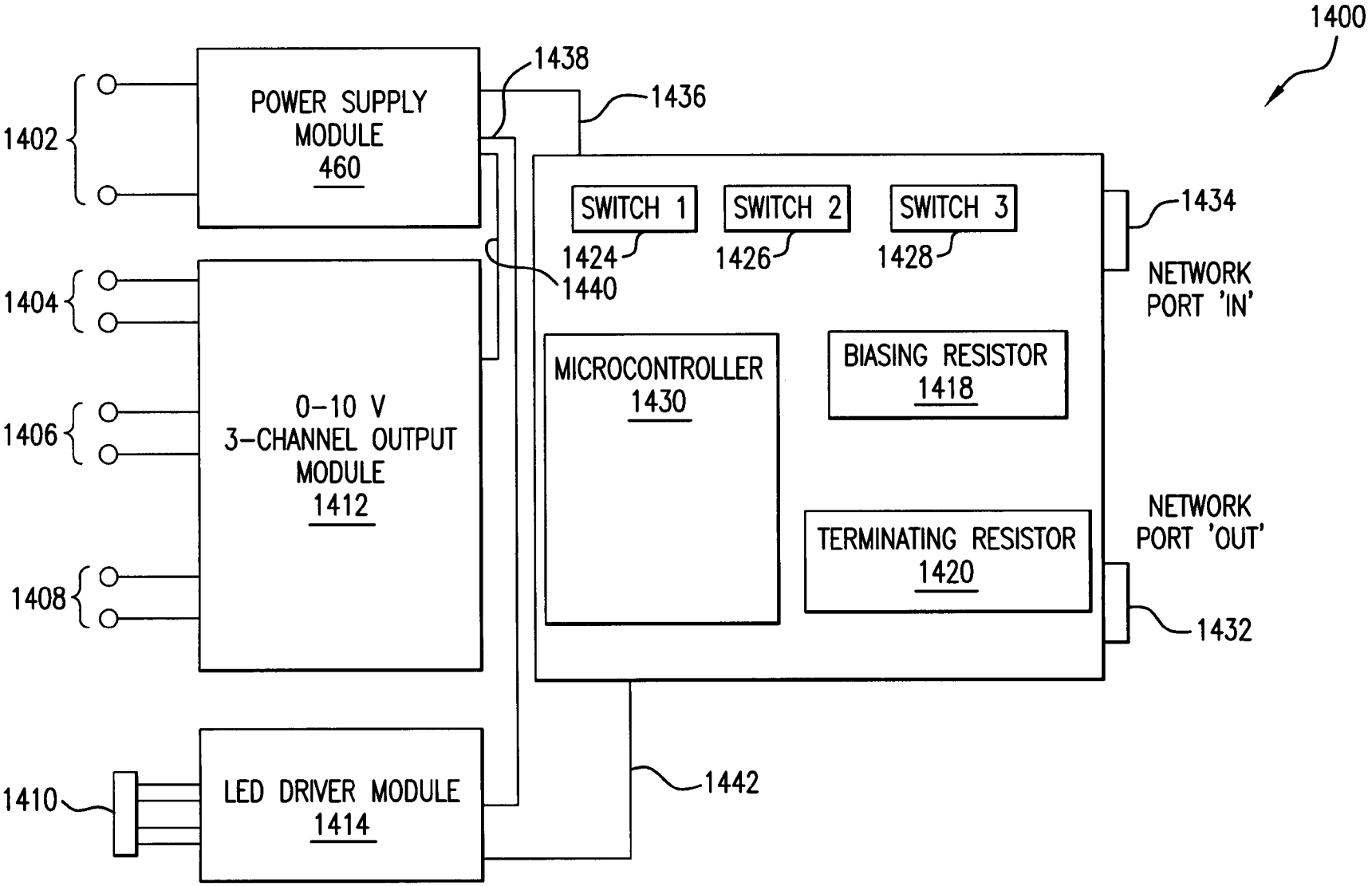
FIGS. 14A-14M are diagrams of a control module according to an embodiment of the present invention.
Figure 14B:
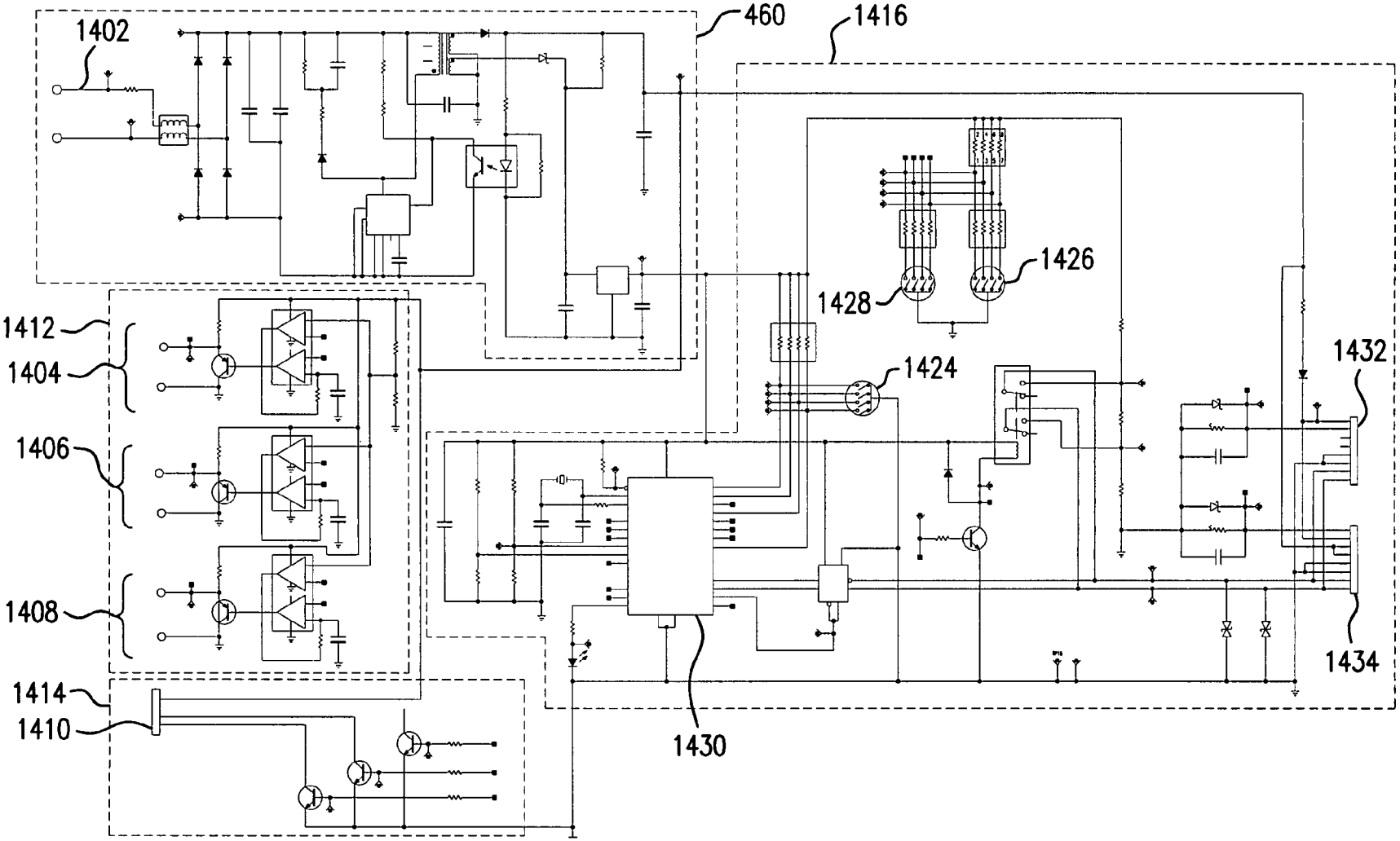
Figure 14C:
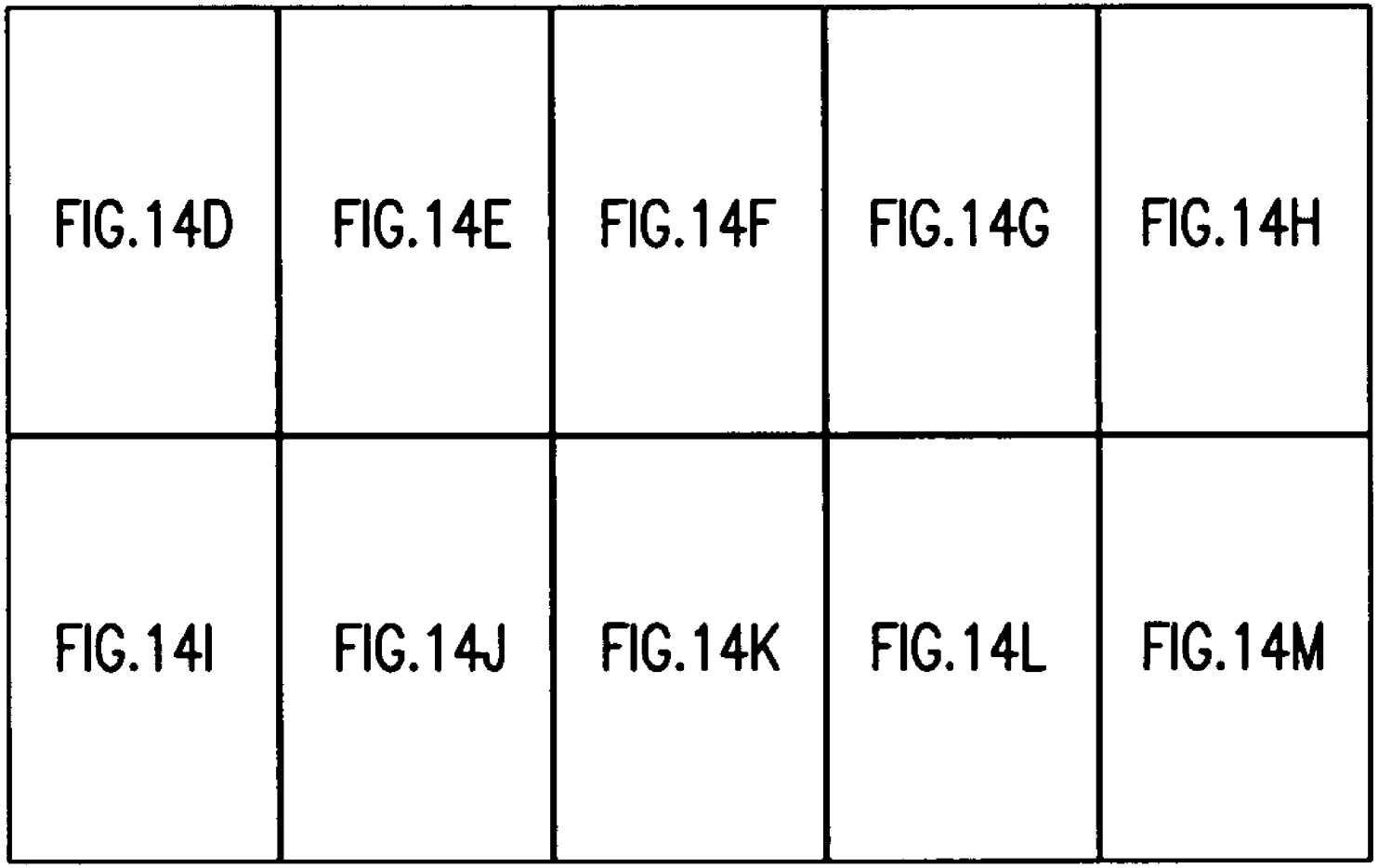
Figure 14D:
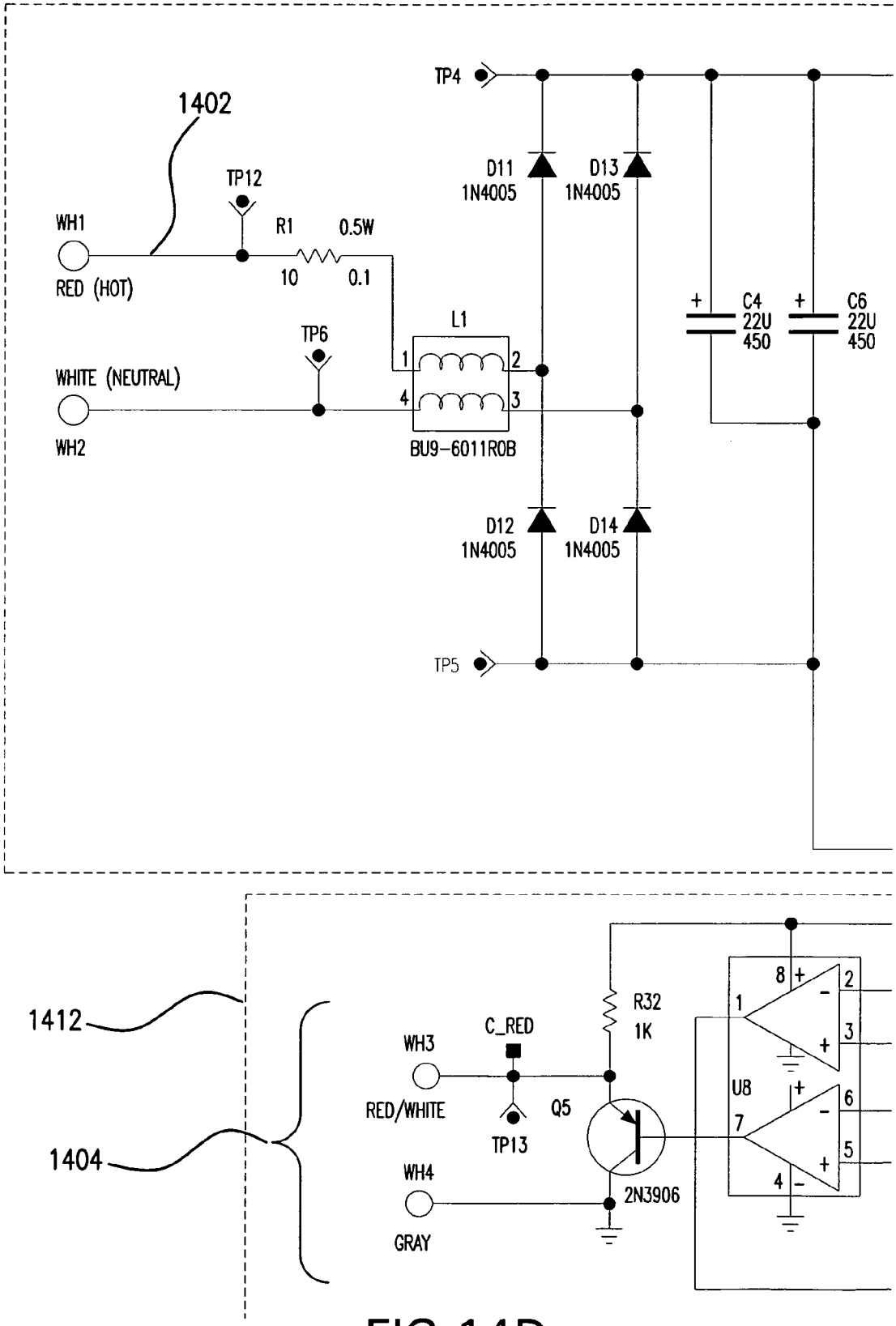

FIGS. 14A and 14B illustrate an exemplary control module 1400 for a luminaire according to an embodiment of the present invention. FIG. 14A is a block diagram, and FIG. 14B is a more detailed circuit diagram. Control module_1400 is configured to drive an LED module, as well as 3 independent 0-10V channels for driving colored fluorescent light sources. Control module_1400 includes a power supply module 460, a 0-10V 3-channel output module 1412, an LED driver module 1414, and a mode control selector and network module 1416. FIG. 14B shows the entire circuit and interconnections for control module 1400. For clarity, the circuit in FIG. 14B has been divided into ten sections, shown in FIGS. 14D-14M. FIG. 14C shows a spatial mapping of the ten sections shown in FIGS. 14D-14M with respect to the entire circuit shown in FIG. 14B. Each of the FIGS. 14D-14M shows enlarged views of the circuit components included in that specific section. For example, FIG. 14D shows enlarged view of a section of control module 1400 that includes portions of power supply module 460 and portions of 0-10V 3-channel output module 1412.

Power supply module 460 has an AC input port 1402, which can be plugged into an AC outlet. Power supply module 460 may have a universal input (120-277 V AC, 50/60 Hz). Module 460 may be designed to provide 9 Watts of output power.

Power supply module 460 may include a common mode choke (such as chip BU-9-6011R0B shown in FIG. 14B and FIG. 14D) to reduce noise when multiple components are coupled to a single power supply module.

Figure 14E:
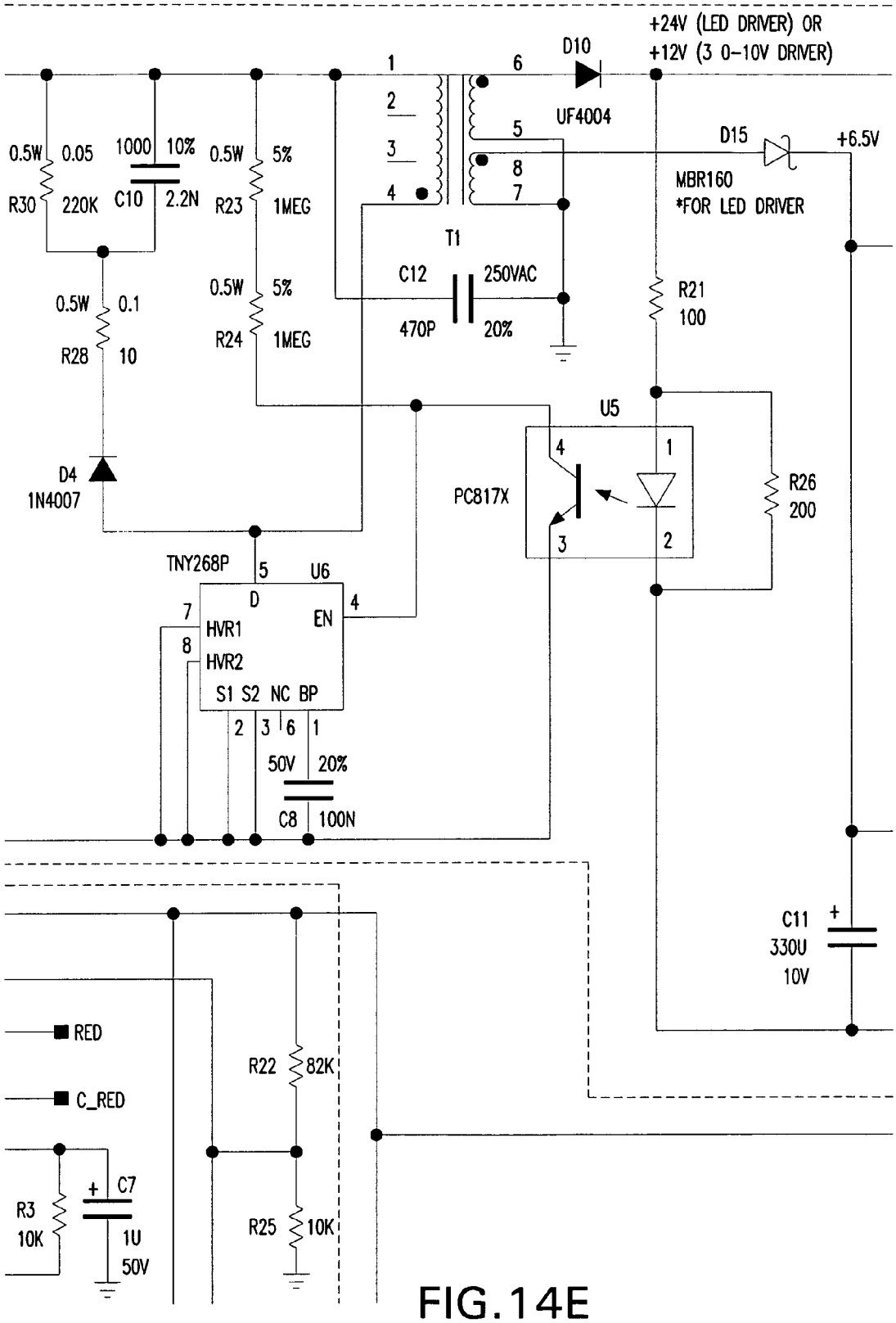
Figure 14F:
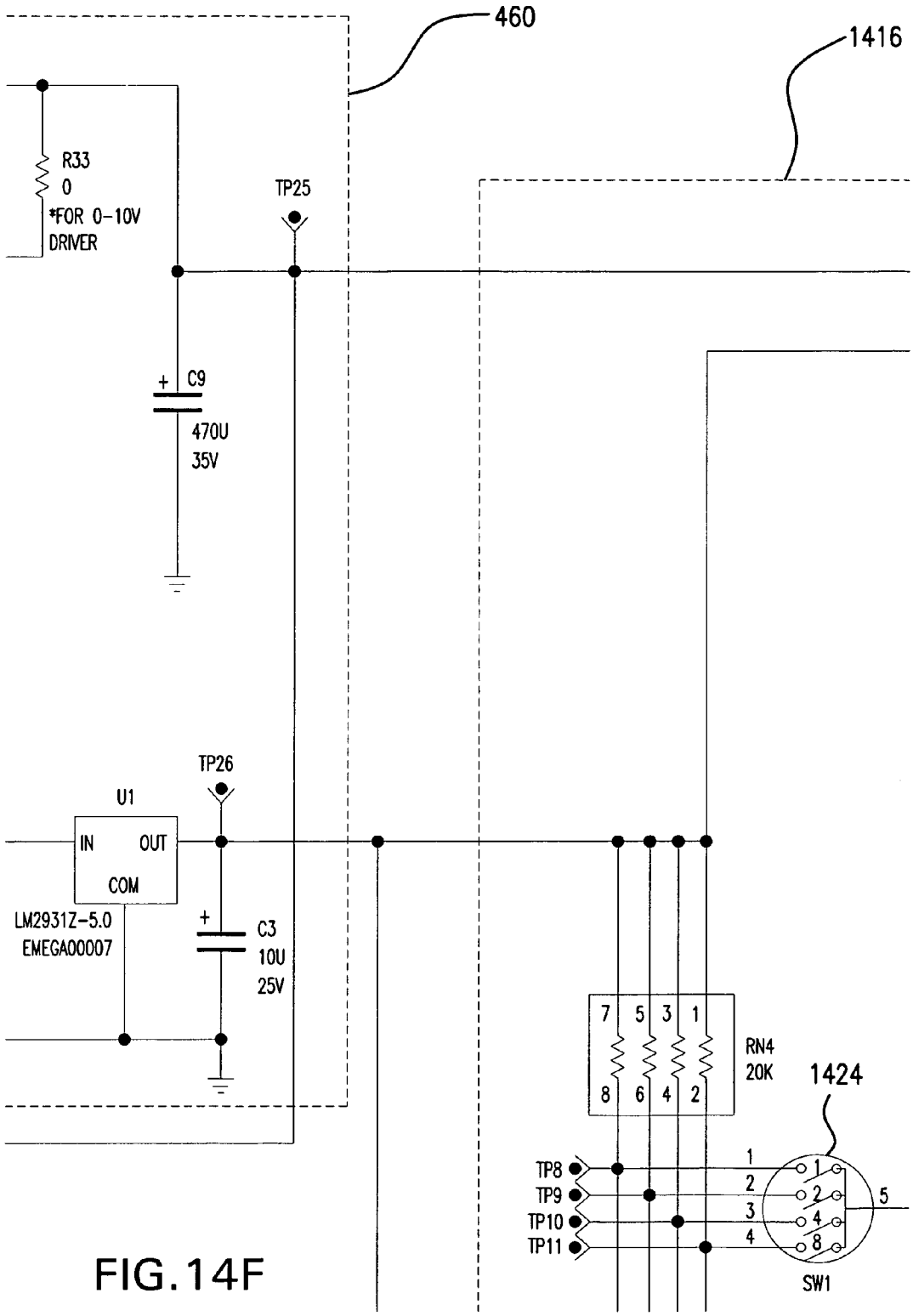
Figure 14G:
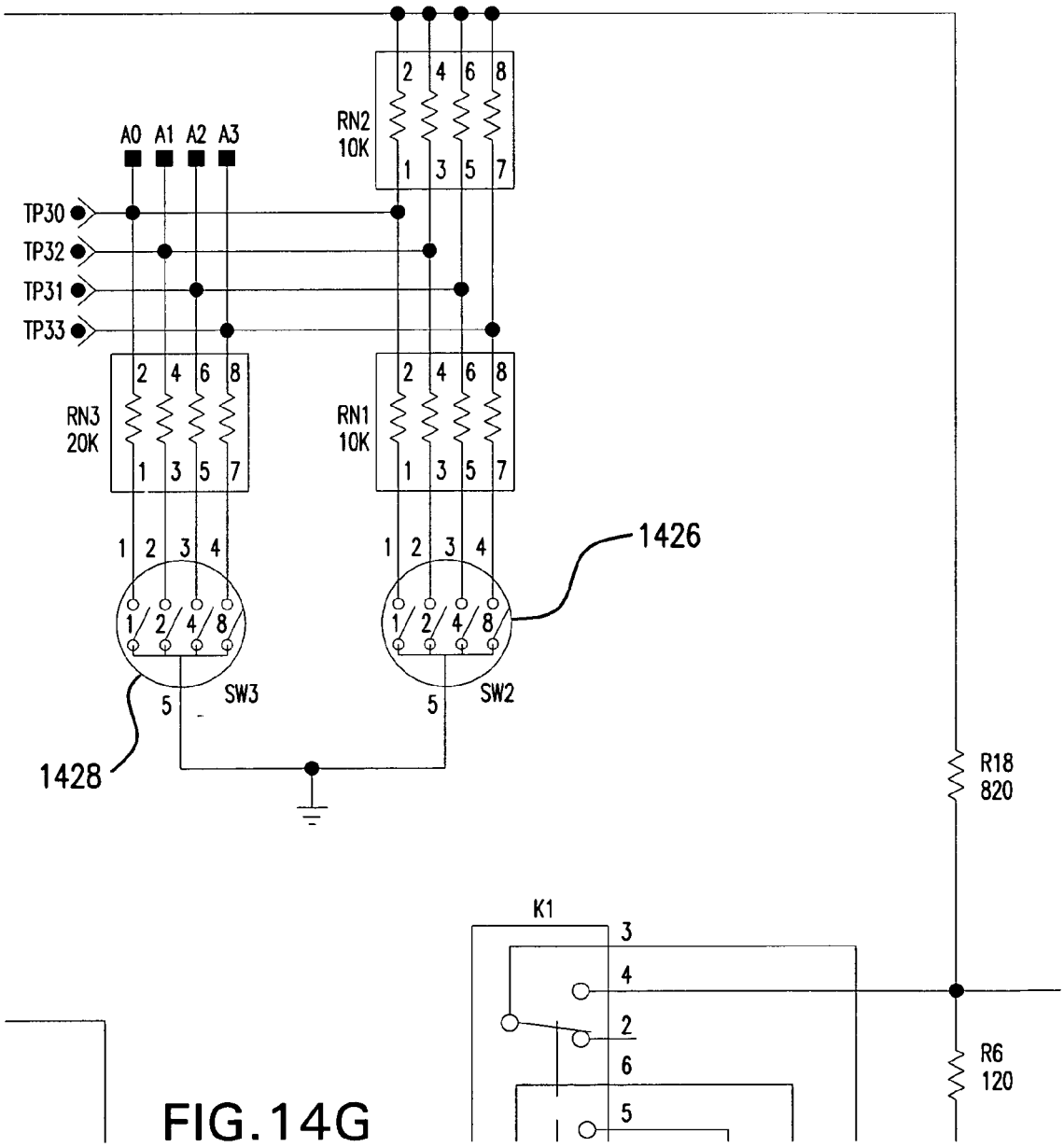
Figure 14H:
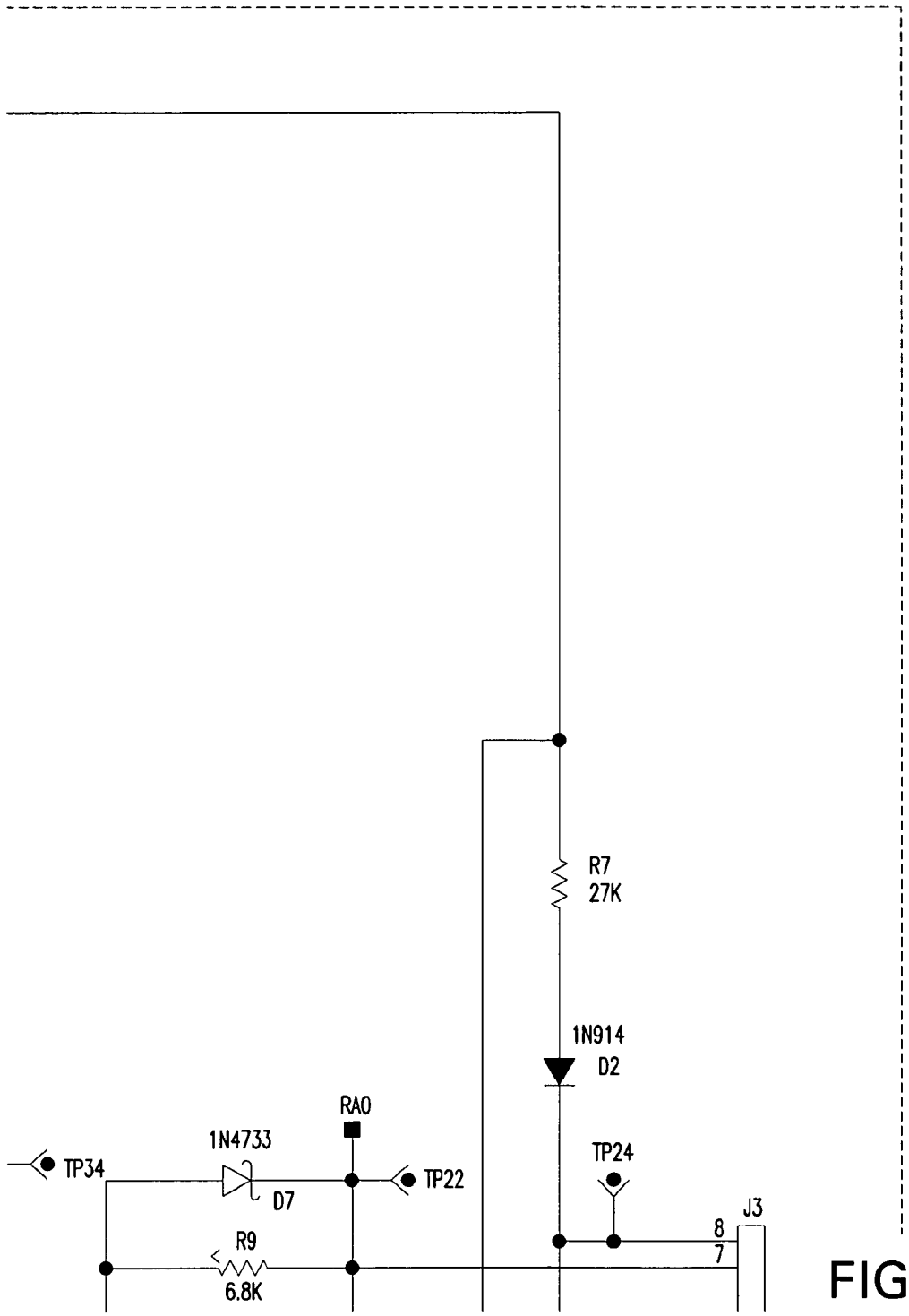
Figure 14I:
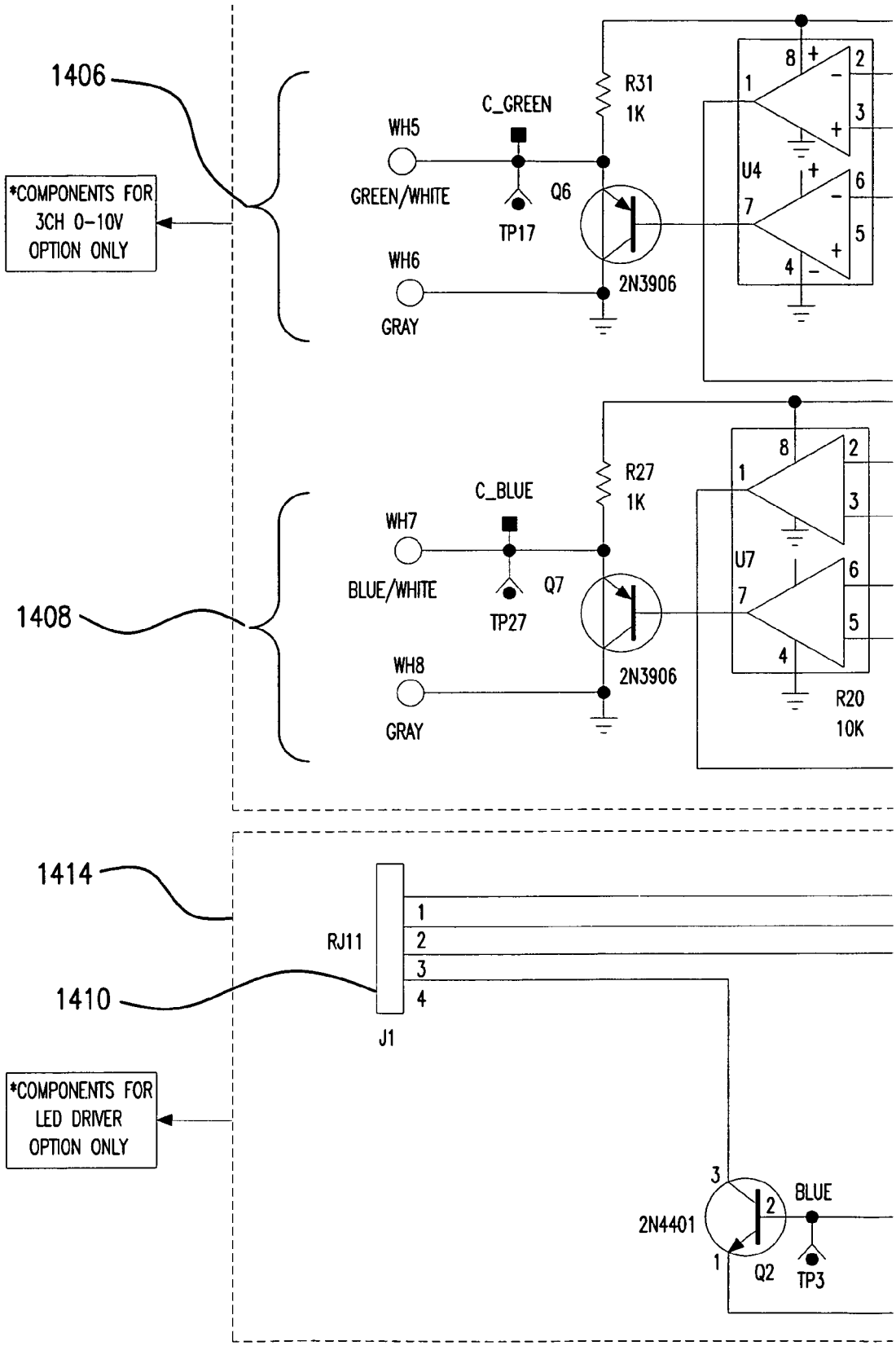
Figure 14J:
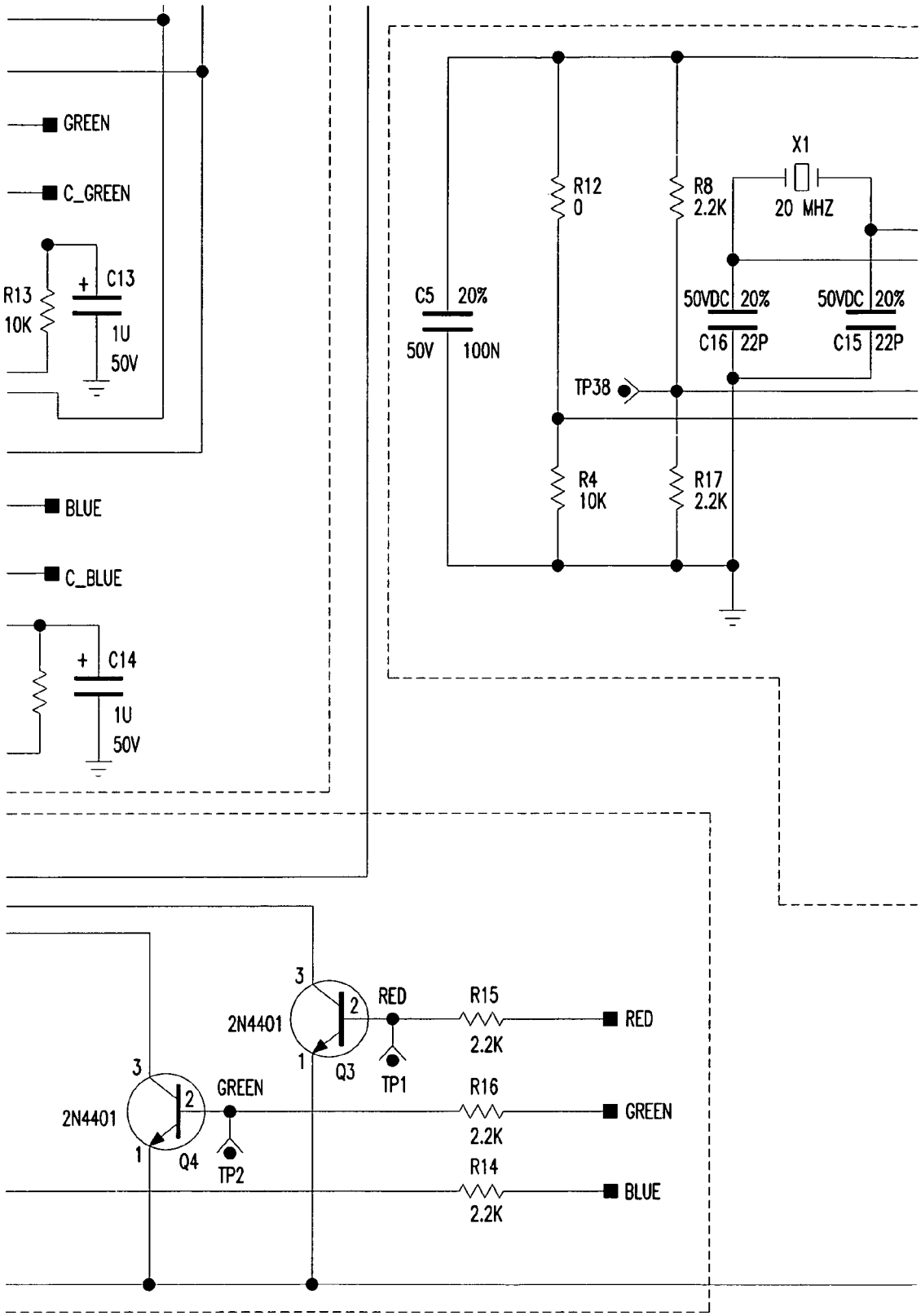

Module 460 provides dual output voltages using a flyback converter topology based on a low-power off-line switcher chip (such as TNY268P shown in FIG. 14B and FIG. 14E). A first output voltage (e.g. 5V) drives digital electronics and communication network components in mode control selector and network module 1416 through power output channel I 1436. A second output voltage (delivered either through power output channel IIA 1438, or through power output channel IIB 1440) drives colored light sources. For example, channel IIA, coupled to LED driver module 1414, may deliver 24V DC to drive LEDs. A RJ11 connector 1410 may couple LED driver module 1414 with LEDs mounted inside the luminaire via standard dual line residential telephone cable with 4 wires. In FIG. 14B and FIG. 14I, connector 1410 is a Molex 15-43-8564 connector.

Channel IIB, coupled to 0-10V 3 channel output module 1412, may deliver 0-10V to drive colored fluorescent sources. Module 1412 has three independent control channels for colored fluorescent sources, namely channel I 1404, channel II 1406, and channel III 1408. A luminaire having fluorescent sources of three colors (for example, red, blue, and green) is driven by these channels. For example, all the red fluorescent sources will be driven by channel I, all the green fluorescent sources will be driven by channel II, and all the blue fluorescent sources will be driven by channel III. Note that, the fluorescent sources emit any three colors in a spectrum, not necessarily red, green, and blue.

Mode control selector and network module 1416 comprises three BCD switches 1424, 1426, and 1428, a microcontroller 1430, a biasing resistor 1418, a terminating resistor 1420, a network "OUT" port 1432, and a network "IN" port 1434. Module 1416 is connected to LED driver module 1414 through connector 1442.

Microcontroller 1430 reads inputs from BCD switches 1424, 1426, and 1428, and controls LED light output by means of a technique called Pulse Frequency Modulation (PFM). PFM is different than pulse width modulation (PWM). In PWM, LED current is controlled by adjusting a duty cycle of the ON pulse from 0 to 100% of the predetermined PWM frequency. In contrast, in PFM, the duty cycle is fixed (for example 0.5%), and the frequency of the pulses is varied from a highest frequency (i.e., pulses very close to each other, resulting in maximum LED output intensity) to a lowest frequency (i.e., pulses are spread widely apart, resulting in minimum LED output intensity).

Figure 14K:
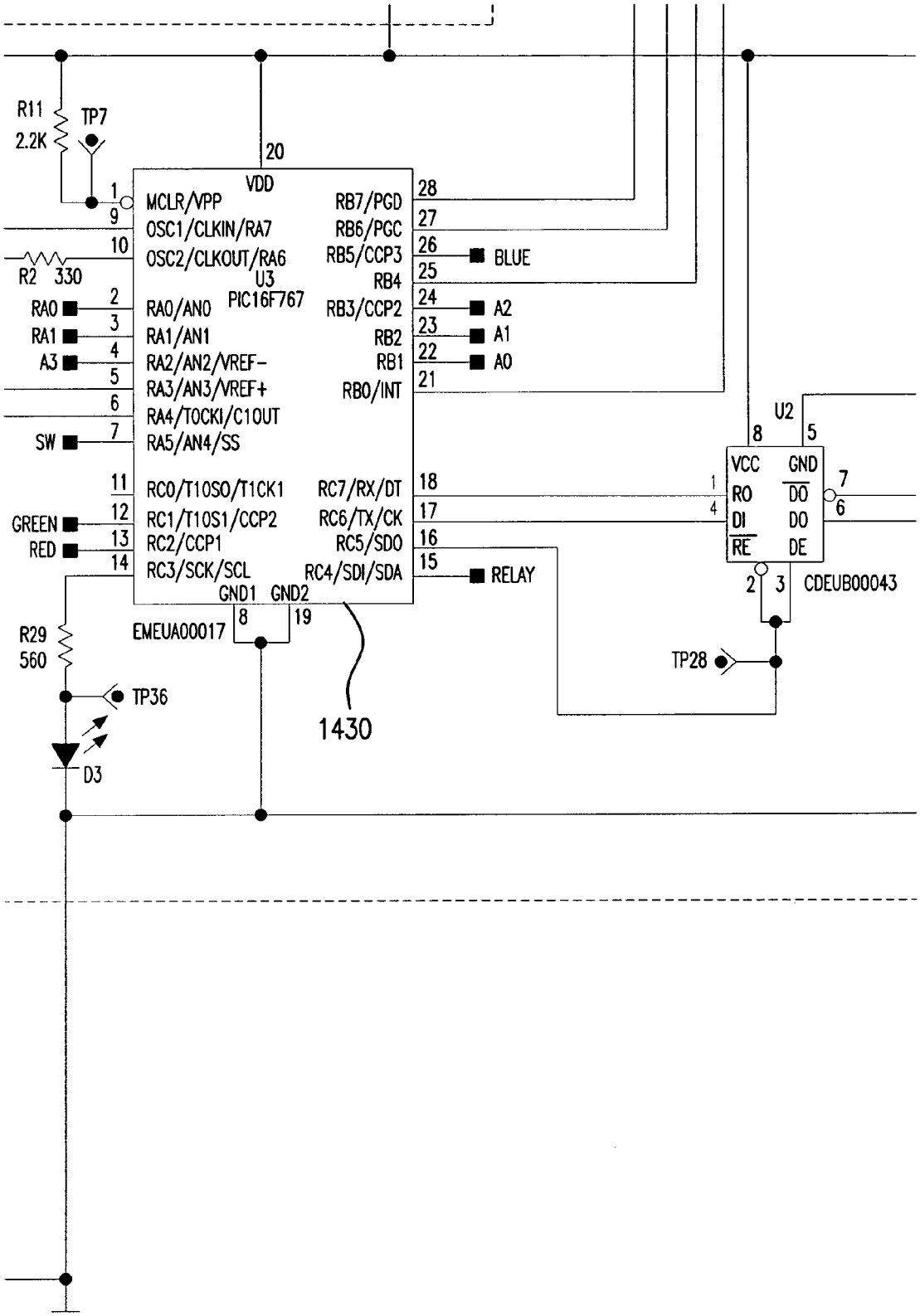
Figure 14L:
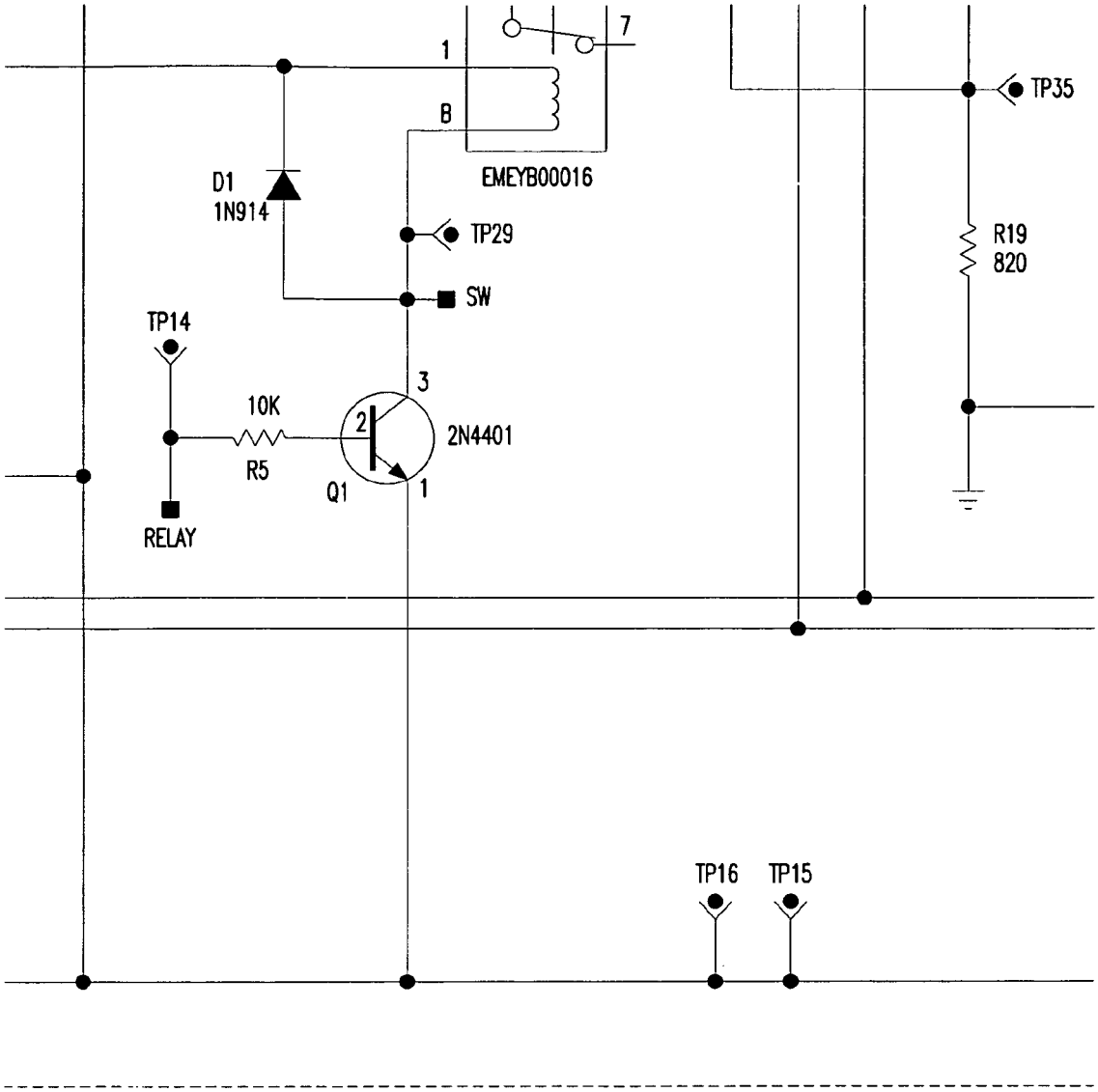
Figure 14M:
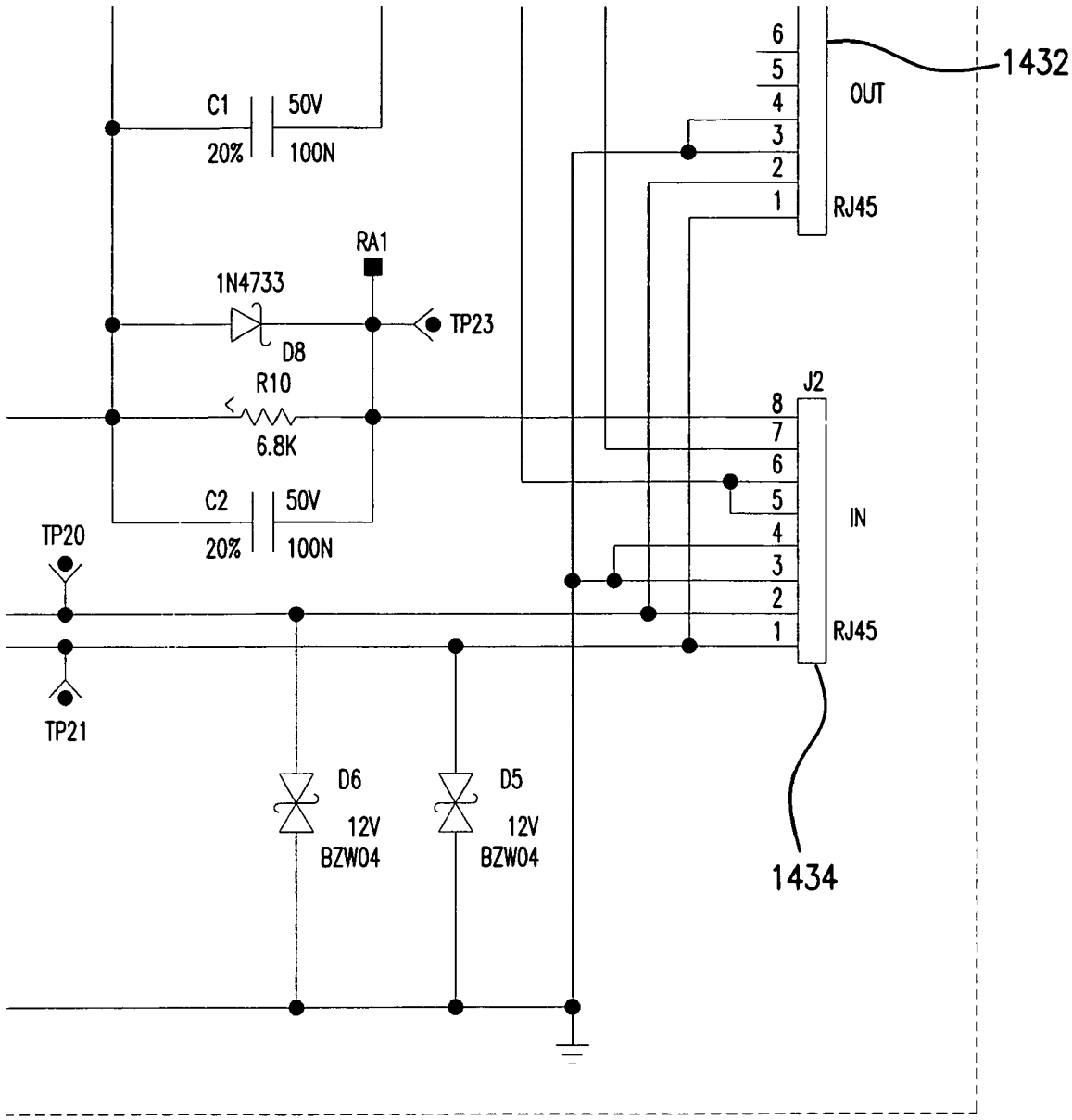

An example microcontroller PIC16F767, available from Microchip Technology, Inc., is shown in FIG. 14B and FIG. 14K. PIC16F767 is a complementary metal oxide semiconductor (CMOS) FLASH-based 8-bit microcontroller, which typically comes in a 28-pin package. PIC16F767 typically features eleven channels of 10-bit Analog-to-Digital (A/D) converter, three timers, three PFM control function modules, synchronous serial ports, a universal asynchronous receiver transmitter, two comparators, internal RC oscillators and advanced low power oscillator controls, among other components. It should be noted that the invention is not limited to using any particular microcontroller, as any suitable microcontrollers can be used to achieve the desired control functionalities.

Multiple luminaires may be connected in a daisy chain in a network via CATx Ethernet cables. Two RJ45 connectors (shown in FIG. 14B, FIG. 14H, and FIG. 14M), such as Molex 15-43-8588 or similar connectors, may be used as network "OUT" port 1432, and network "IN" port 1434. Microcontroller 1430 also helps in communication with other luminaires in the network. Communication is based on the RS485 networking protocol, which utilizes a single transmitter chip controlled by microcontroller 1430.

The luminaires may be connected in a master-slave configuration. In a master-slave network, the user is required to set switches indicating the selection of operational mode and color cycle time (as described above with reference to FIGS. 11-13) on an interface board for the master unit only. Any luminaire in the network may be configured as the master unit. Slave units ignore input switch settings, and obey control commands (signals controlling intensity level of each color) received from the master unit via the RS485 network connections. Slave units respond to control commands by acting in synchronization with the master unit. Microcontroller 1430 in each unit detects whether the luminaire is in a master-slave network configuration, and whether the particular unit is a master unit or a slave unit. In the master-slave embodiment, two BCD switches in the slave units become address select switches, so that each slave unit may be individually addressed by the master unit. This way a user may add a lot of variety in creating decorative effects because all the luminaires are individually addressable, and any one can act as the master unit at any point in time.

For RS485 communications, it is necessary to terminate the ends of the communication cable with terminating resistors that match the impedance of the CATx Ethernet cable. In conventional networks, the user has to manually engage the terminating resistors with the switches. In an embodiment of the present invention, the last slave driver in the daisy chain automatically engages the terminating resistor included in its driving circuitry. Only the terminating resistor in the last slave unit needs to be engaged, reducing the power requirements for driving the network significantly (as much as a 50% reduction in power requirement is possible).

The last slave unit also engages the biasing resistors for the network to ensure that the voltage across the network (and each node) exceeds 0.2V in tri-state mode, when no transmitter is driving the network.

It is noted that each luminaire unit can be controlled as a stand-alone unit, or a master unit, which may or may not have a slave unit associated with it.

CONCLUSION

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A luminaire, comprising:

a first reflector having an inner space and an inner surface, wherein an upper portion of the inner surface of the first reflector defines a light mixing portion;

a second reflector having an inner space and an inner surface, the second reflector being at least partially disposed within the inner space of the first reflector;

a third reflector having an inner space, an inner surface, and an outer surface, wherein light emitted from a lamp at least partially disposed within the inner space of the third reflector is reflected by a portion of the inner surface of the third reflector and exits through an opening of the third reflector; the third reflector being at least partially disposed within the inner space of the second reflector;

a plurality of colored light sources disposed within the inner space of the first reflector, wherein light emitted by the plurality of colored light sources is reflected by the light mixing portion of the inner surface of the first reflector and passes through a plenum formed by a portion of the outer surface of the third reflector and a portion of the inner surface of the second reflector, wherein the plurality of colored light sources are positioned to face the light mixing portion defined by the upper portion of the inner surface of the first reflector; and a control module coupled to the plurality of colored light sources that controls an intensity of each of the plurality of colored light sources.

2. The luminaire of claim 1, wherein the intensity of a first colored light source is controllable independently of the intensity of a second colored light source.

3. The luminaire of claim 1, wherein the intensity of a first group of colored light sources is controllable independently of the intensity of a second group of colored light sources.

4. The luminaire of claim 3, wherein the plurality of colored light sources are mounted on a circuit board having at least one electrical connector that couples the plurality of colored light sources to the control module.

5. The luminaire of claim 4, wherein the at least one electrical connector is an RJ11 telephone jack connector.

6. The luminaire of claim 1, wherein the plurality of colored light sources are colored light-emitting-diodes.

7. The luminaire of claim 1, further comprising a light socket coupled to the control module.

8. The luminaire of claim 7, wherein the light socket is one of a fluorescent lamp light socket, an incandescent lamp light socket, and a light emitting diode light socket.

9. The luminaire of claim 1, wherein the luminaire further comprises a dimmable ballast coupled to the control module.

10. The luminaire of claim 1, wherein the control module comprises a universal input power supply that provides a first output voltage and a second output voltage, the first output voltage for powering the plurality of colored light sources and the second output voltage for powering electronic components of the control module.

11. The luminaire of claim 1, wherein the control module comprises a first multi-position binary coded decimal switch that selects one of a plurality of operational modes, wherein one of the operational modes is a self-diagnostics mode.

12. The luminaire of claim 1, wherein the control module comprises at least one multi-position binary coded decimal switch that controls cycle time.

13. The luminaire of claim 1, wherein the control module comprises a pulse frequency modulation power supply.

14. The luminaire of claim 1, wherein the control module comprises a flyback converter power supply.

15. The luminaire of claim 1, wherein the control module comprises a network input port and a network output port.

16. The luminaire of claim 15, wherein the control module comprises a biasing resistor.

17. The luminaire of claim 15, wherein the control module comprises a terminating resistor that automatically engages if the network output port is not coupled to another luminaire.

18. The luminaire of claim 15, wherein the network input port and the network output port comprise RJ45 connectors.

19. The luminaire of claim 1, wherein the control module comprises a microcontroller.

20. The luminaire of claim 1, wherein the upper portion of the inner surface that defines the light mixing portion is substantially horizontal.

21. The luminaire of claim 1, wherein the light mixing portion is coated with an optical coating.

22. The luminaire of claim 1, wherein a size of the plenum is adjustable by varying a position of the third reflector relative to the first reflector.

* * * * *

UNITED STATES PATENT AND TRADEMARK OFFICE

CERTIFICATE OF CORRECTION

PATENT NO. : 7,614,767 B2
APPLICATION NO. : 11/449768
DATED : November 10, 2009
INVENTOR(S) : Zulim et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 541 days.

Signed and Sealed this

Fourteenth Day of December, 2010

David J. Kappos

David J. Kappos
*Director of the United States Patent and Trademark Office*